US009523954B2

(12) United States Patent
Oshima et al.

(10) Patent No.: US 9,523,954 B2
(45) Date of Patent: Dec. 20, 2016

(54) IMAGE FORMING APPARATUS THAT PERFORMS DEVELOPER REPLENISHMENT

(71) Applicant: CANON KABUSHIKI KAISHA, Tokyo (JP)

(72) Inventors: Kana Oshima, Tokyo (JP); Jiro Shirakata, Chigasaki (JP); Shusuke Miura, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/867,420

(22) Filed: Sep. 28, 2015

(65) Prior Publication Data

US 2016/0097991 A1 Apr. 7, 2016

(30) Foreign Application Priority Data

Oct. 1, 2014 (JP) ..... 2014-203057
Feb. 16, 2015 (JP) ..... 2015-027509

(51) Int. Cl.
*G03G 15/00* (2006.01)
*G03G 15/08* (2006.01)

(52) U.S. Cl.
CPC ..... *G03G 15/556* (2013.01); *G03G 15/0829* (2013.01); *G03G 15/0832* (2013.01)

(58) Field of Classification Search
CPC ..... G03G 15/0832; G03G 15/0834; G03G 15/0839; G03G 15/0824; G03G 15/0829; G03G 15/556
See application file for complete search history.

(56) References Cited

U.S. PATENT DOCUMENTS 5,887,221 A * 3/1999 Grace ..... G03G 15/0849 399/27
6,374,064 B1 * 4/2002 Budnik ..... G03G 15/0849 399/27
6,456,802 B1 * 9/2002 Phillips ..... B41J 2/17566 347/7

(Continued)

FOREIGN PATENT DOCUMENTS

JP H04-304486 A 10/1992
JP 2008-020695 A 1/2008

*Primary Examiner* — David Gray
*Assistant Examiner* — Trevor J Bervik
(74) *Attorney, Agent, or Firm* — Fitzpatrick, Cella, Harper & Scinto

(57) ABSTRACT

An image forming apparatus includes a photosensitive member, an exposure unit, a developing unit that develops an electrostatic latent image using toner, a detection unit that detects an amount of the toner contained in the developing unit, and a calculation unit that calculates a difference value between the amount of detected toner detected and a target toner amount. In addition, an accumulation unit accumulates the calculated difference value, and a controller controls toner replenishing based on the calculated difference value and the accumulated value. A determination unit determines, based on an amount of the consumed toner and an amount of the contained toner, whether or not an error of an amount of replenished toner is larger than a threshold value, and determines, based on the number of times that the error is determined, whether or not replacement of the container is required.

8 Claims, 16 Drawing Sheets

(56) References Cited

U.S. PATENT DOCUMENTS

| | | | | |
|---|---|---|---|---|
| 6,463,224 | B1 * | 10/2002 | Phillips | G03G 15/0849 399/27 |
| 7,761,015 | B2 * | 7/2010 | Wong | G03G 15/0822 399/224 |
| 2007/0058996 | A1 * | 3/2007 | Sakita | G03G 15/553 399/27 |
| 2012/0070167 | A1 * | 3/2012 | Oya | G03G 15/556 399/28 |
| 2012/0207490 | A1 * | 8/2012 | Itoyama | G03G 15/086 399/27 |

* cited by examiner

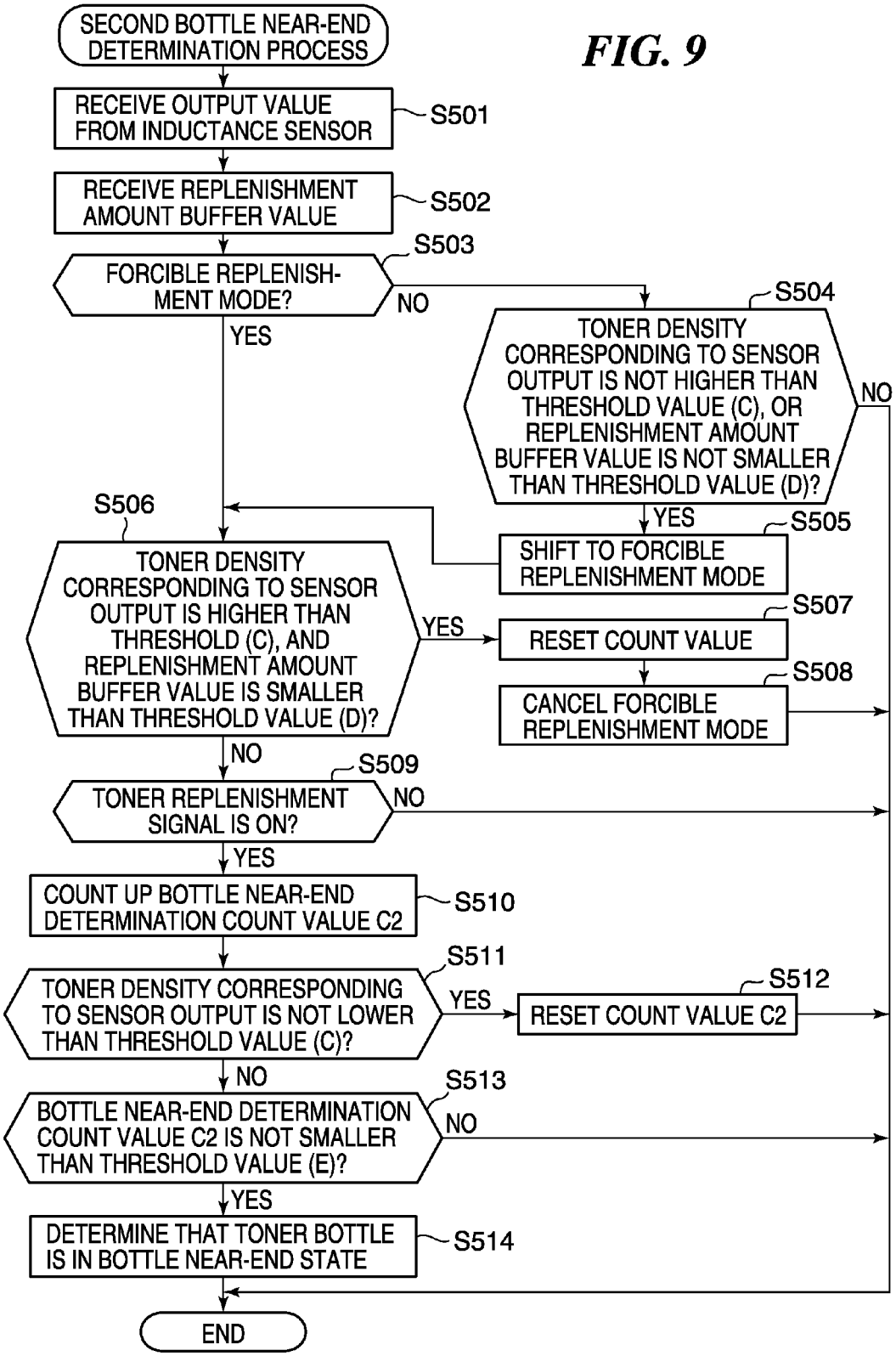
FIG. 9
SECOND BOTTLE NEAR-END DETERMINATION PROCESS
RECEIVE OUTPUT VALUE FROM INDUCTANCE SENSOR
S501
RECEIVE REPLENISHMENT AMOUNT BUFFER VALUE
S502
S503
FORCIBLE REPLENISHMENT MODE?
NO
YES
S504
TONER DENSITY CORRESPONDING TO SENSOR OUTPUT IS NOT HIGHER THAN THRESHOLD VALUE (C), OR REPLENISHMENT AMOUNT BUFFER VALUE IS NOT SMALLER THAN THRESHOLD VALUE (D)?
NO
YES
S505
SHIFT TO FORCIBLE REPLENISHMENT MODE
S506
TONER DENSITY CORRESPONDING TO SENSOR OUTPUT IS HIGHER THAN THRESHOLD (C), AND REPLENISHMENT AMOUNT BUFFER VALUE IS SMALLER THAN THRESHOLD VALUE (D)?
YES
S507
RESET COUNT VALUE
S508
CANCEL FORCIBLE REPLENISHMENT MODE
NO
S509
TONER REPLENISHMENT SIGNAL IS ON?
NO
YES
COUNT UP BOTTLE NEAR-END DETERMINATION COUNT VALUE C2
S510
S511
TONER DENSITY CORRESPONDING TO SENSOR OUTPUT IS NOT LOWER THAN THRESHOLD VALUE (C)?
YES
S512
RESET COUNT VALUE C2
NO
S513
BOTTLE NEAR-END DETERMINATION COUNT VALUE C2 IS NOT SMALLER THAN THRESHOLD VALUE (E)?
NO
YES
DETERMINE THAT TONER BOTTLE IS IN BOTTLE NEAR-END STATE
S514
END

IMAGE FORMING APPARATUS THAT PERFORMS DEVELOPER REPLENISHMENT

BACKGROUND OF THE INVENTION

Field of the Invention

The present invention relates to an image forming apparatus, and more particularly to an image forming apparatus that estimates an error of an amount of developer supplied to a developer containing section of a developing device, and determines a replacement time at which a developer bottle for supplying developer to the developing device is to be replaced.

Description of the Related Art

In an image forming apparatus, such as a copy machine and a laser beam printer, bottle near-end determination for determining a replacement time which is immediately before a toner (developer) bottle becomes empty is performed, and when it is determined that the toner bottle is in a near-end state, a message for prompting a user to replace the toner bottle is displayed.

Conventionally, toner is supplied from a toner bottle to a developing device via a toner replenishment container, which is called a hopper. The hopper is provided with a measurement sensor, and a toner replenishment amount error is calculated by using an amount of toner within the hopper, which is detected by the measurement sensor. The toner replenishment amount error is the difference between a nominal toner replenishment amount per one pumping operation and an actual toner replenishment amount. Then, the bottle near-end determination is performed based on a tendency of the toner replenishment amount error to increase in a negative direction as the toner bottle becomes closer to the bottle near-end state.

However, in recent years, image forming apparatuses are required to perform the bottle near-end determination without a measurement sensor to meet a demand for cost reduction of the whole image forming apparatus. Further, in accordance with the size reduction of image forming apparatuses, a configuration is widely employed which directly supplies toner from a toner bottle to a developing device without providing a hopper. An apparatus having the configuration without a hopper is not equipped with a measurement sensor which is provided in the hopper, and hence is required to estimate a toner replenishment amount error without using a toner amount measured by the measurement sensor, and thereby perform the bottle near-end determination.

As the image forming apparatus that estimates the toner replenishment amount error without using the measurement sensor, there has been known an image forming apparatus that uses a pixel count acquired from image data and a toner replenishment amount calculated based on the number of times of toner replenishment. More specifically, there has been proposed a technique of stabilizing toner density by reducing the toner replenishment amount in a case where an amount of change in the cumulative value of the toner replenishment amount with respect to the cumulative value of the pixel count of each formed image is larger than an upper limit value, but increasing the toner replenishment amount in a case where the amount of change is smaller than a lower limit value (see e.g. Japanese Patent Laid-Open Publication No. 2008-20695).

However, although in the above-described technique, the tendency of the toner replenishment amount error can be estimated with respect to a toner bottle as a unit, it is impossible to estimate the toner replenishment amount error which changes in a progressively increasing manner in the negative direction toward the bottle-end state. This causes a problem that it is impossible to properly determine the bottle near-end state of the toner bottle using the estimated toner replenishment amount error.

Further, conventionally, an image forming apparatus of an electrophotographic type forms a toner image based on image data input to the image forming apparatus by consuming toner in developer contained in a developer containing section of a developing device or the like. In such an image forming apparatus, it is known that the density of an image to be formed by the image forming apparatus varies with a ratio of toner in the developer contained in the developer containing section.

For this reason, the conventional image forming apparatuses include one that predicts an amount of toner consumed from the developer containing section (toner consumption amount) through formation of a toner image based on image data, and determines a toner replenishment amount so as to control the ratio of toner in the developer containing section such that it becomes equal to a target value. Note that the toner consumption amount is a theoretically calculated value, and hence there is a small error between an actual consumption amount of toner which is actually consumed from the developer containing section, and the above-mentioned determined amount of toner consumption. That is, even when an amount of toner corresponding to the determined toner consumption amount is supplied, the ratio of toner in the developer containing section sometimes does not necessarily become equal to the target value.

On the other hand, there has been known a toner replenishment device that corrects the toner replenishment amount corresponding to the toner consumption amount, using a correction amount calculated based on the ratio of toner in the developer containing section (see e.g. Japanese Patent Laid-Open Publication No. H04-304486). However, the toner replenishment device described in Japanese Patent Laid-Open Publication No. H04-304486 has a problem that in a case where after a plurality of images each of which consumes a small amount of toner have been formed in a state in which the ratio of toner in the developer containing section is higher than the target value, a plurality of images each of which consumes a large amount of toner are formed, toner is not immediately supplied to the developer containing section.

In the case where a plurality of images each of which consumes a small amount of toner are formed in the state in which the ratio of toner in the developer containing section is higher than the target value, the above-mentioned correction amount takes such a value as will suppress the toner replenishment amount. That is, in the state in which the ratio of toner in the developer containing section is higher than the target value, the above-mentioned correction amount becomes a negative value.

Therefore, when forming images each of which consumes a large amount of toner, after having formed a plurality of images each of which consumes a small amount of toner, the toner replenishment amount calculated based on the toner consumption amount predicted according to the images each of which consumes the large amount of toner and the correction amount becomes equal to or less than 0. As a consequence, even though formation of the images each consuming the large amount of toner is started, so that the ratio of toner in the developer containing section is reduced, toner is not supplied to the developer containing section.

SUMMARY OF THE INVENTION

The present invention provides an image forming apparatus that is capable of accurately estimating a developer replenishment amount error which changes in a progressively increasing manner in a negative direction toward a replacement time of a developer replenishment unit, and thereby properly determining the replacement time of the developer replenishment unit.

The invention provides an image forming apparatus comprising an image forming section including a photosensitive member, an exposure unit configured to expose the photosensitive member based on image data to form an electrostatic latent image, and a developing unit configured to contain developer having toner and develop the electrostatic latent image using the toner, a supply unit including a motor and configured to drive the motor based on a drive signal to supply toner from a container containing toner to the developing unit, a measurement unit configured to measure first information corresponding to a ratio of the toner in the developing unit to the developer in the developing unit, an obtaining unit configured to obtain, based on the image data, second information corresponding to an amount of the toner consumed from the developing unit, a controller configured to control whether or not to output the drive signal, based on the first information measured by the measurement unit and the second information obtained by the obtaining unit, an estimation unit configured to estimate, according to output of the drive signal from the controller, an error of a replenishment amount of the toner supplied from the container to the developing unit, based on the first information measured by the measurement unit and the second information obtained by the obtaining unit, and a determination unit configured to determine, based on the error estimated by the estimation unit, whether or not it is necessary to perform replacement of the container.

According to the present invention, the first information corresponding to a ratio of toner in the developing unit to the developer in the developing unit is measured, the second information corresponding to an amount of the toner consumed from the developing unit is obtained based on the image data, and it is controlled, based on the measured first information and the obtained second information, whether or not to output the drive signal to the supply unit that includes the motor and controls the motor driven for supplying toner from the container to the developing unit. Further, according to the output of the drive signal, an error of the replenishment amount of toner supplied from the container to the developing unit is estimated based on the measured first information and the obtained second information, and it is determined based on the estimated error whether or not it is necessary to perform replacement of the container. Therefore, it is possible to properly determine the replacement time of the developer replenishment unit.

Further features of the present invention will become apparent from the following description of exemplary embodiments (with reference to the attached drawings).

BRIEF DESCRIPTION OF THE DRAWINGS

FIG. 9 is a flowchart of a second bottle near-end determination process performed in a step of the bottle near-end determination process in FIG. 7.

DESCRIPTION OF THE EMBODIMENTS

The present invention will now be described in detail below with reference to the accompanying drawings showing embodiments thereof.

Figure 1:
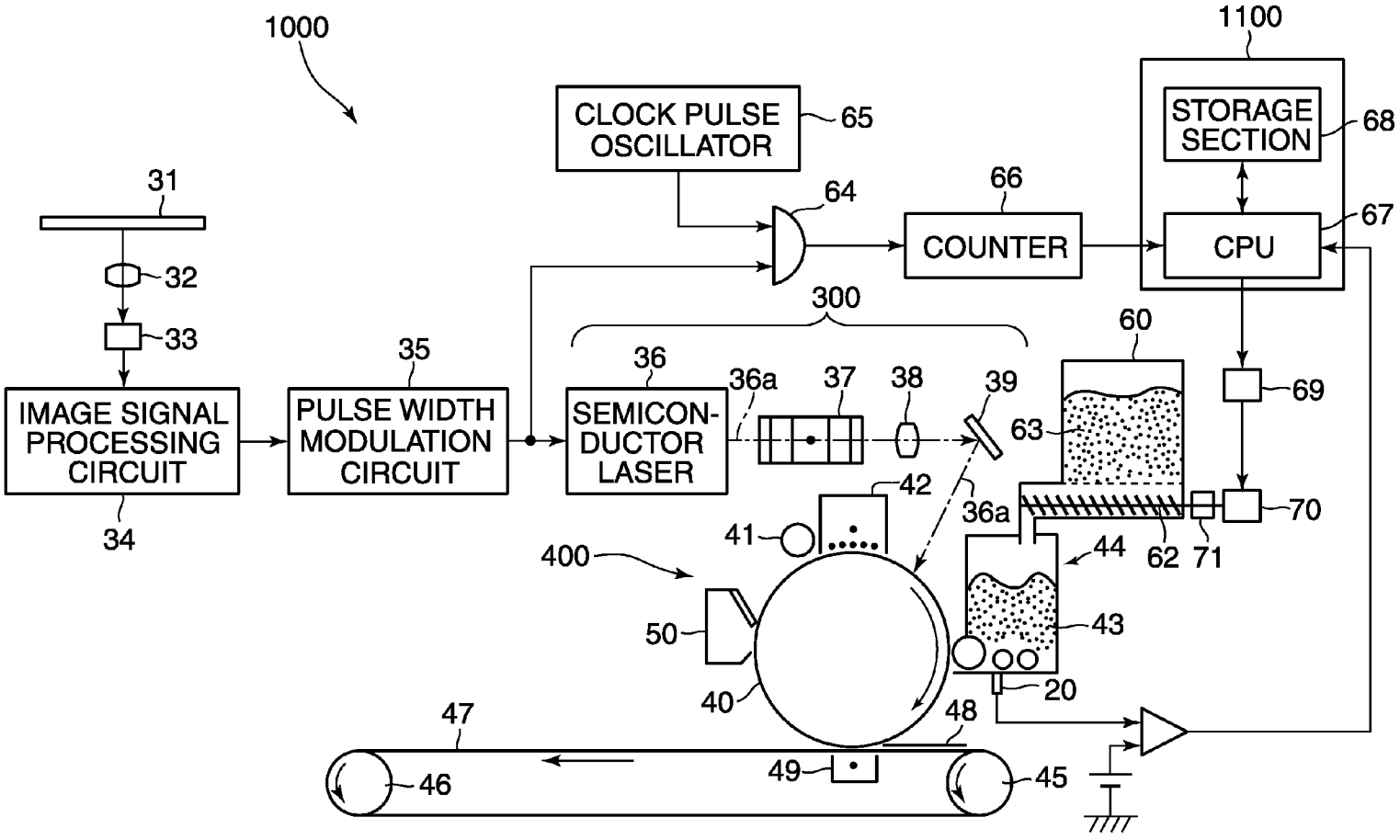
FIG. 1 is a schematic diagram of an image forming apparatus to which the present invention is applied.

FIG. 1 is a schematic diagram of an image forming apparatus to which the present invention is applied. This image forming apparatus is an electrophotographic digital copy machine. However, the present invention is not limitedly applied to this type of image forming apparatus, but is equally applicable to various image forming apparatuses including image forming apparatuses of an electrophotographic type and image forming apparatuses of an electrostatic recording type. That is, the present invention can be widely applied to image forming apparatuses which are configured to form a latent image corresponding to image data, for example, on an image bearing member, such as a photosensitive member or a dielectric member, by using an electrophotographic method, an electrostatic recording method, or the like, develop the formed latent image into a visible image, thereafter transfer the visible image onto a transfer member, and fix the visible image thereon.

Referring to FIG. 1, the image forming apparatus, denoted by reference numeral 1000, includes an image forming section 400 as a hardware component. The image forming section 400 includes a photosensitive drum 40 as the image bearing member, a static eliminator 41 disposed in a manner opposed to the photosensitive drum 40, a primary charger 42, a developing device 44, a drum cleaner 50, and an exposure section 300 that forms an electrostatic latent image on a surface of the photosensitive drum 40. The exposure section 300 includes a semiconductor laser 36 as a light source, a rotary polygon mirror 37, an f/θ lens 38, and a fixed mirror 39. The exposure section 300 exposes the photosensitive drum 40 based on image data of an original 31, which has been read by an image pickup device 33 via a lens 32, and thereby forms an electrostatic latent image corresponding to the original 31.

The developing device 44 is provided with a toner bottle 60 for supplying toner 63 as a developer component to the developing device 44. The toner bottle 60 is provided with a conveying screw 62, and a motor 70 and a gear train 71 for driving the conveying screw 62.

Figure 2:
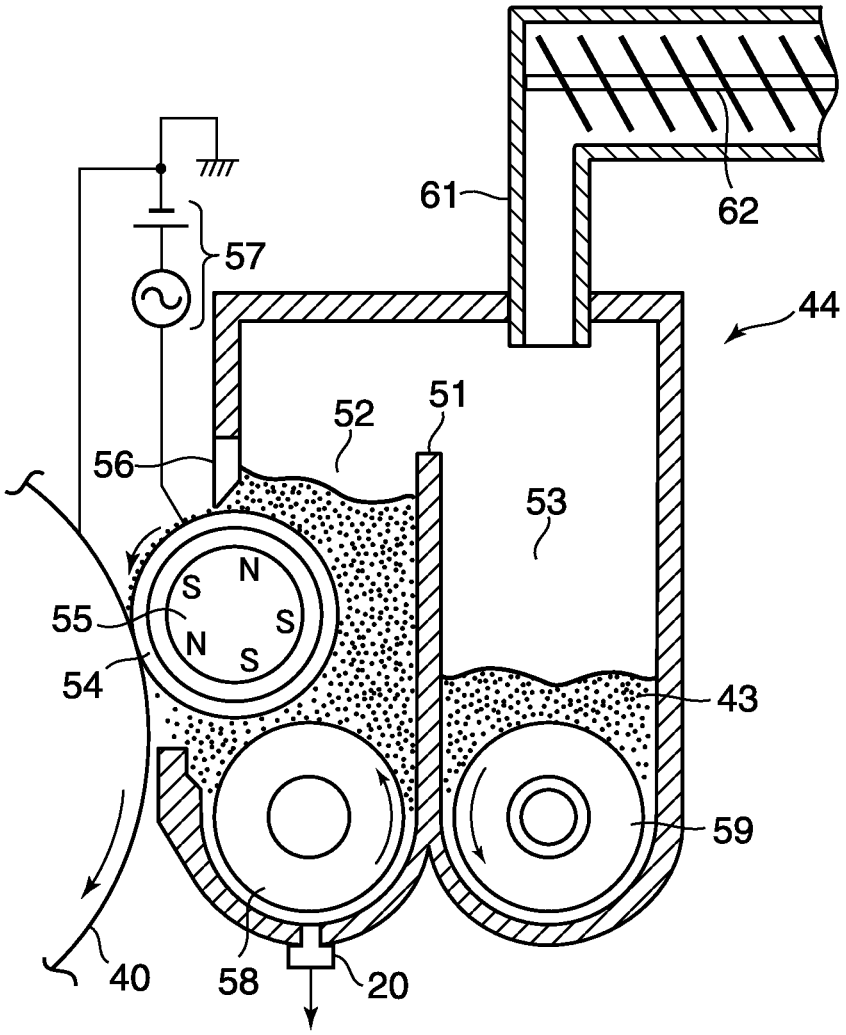
FIG. 2 is a schematic cross-sectional diagram of a developing device of the image forming apparatus shown in FIG. 1.

FIG. 2 is a schematic cross-sectional diagram of the developing device 44 of the image forming apparatus 1000 shown in FIG. 1.

Referring to FIG. 2, the developing device 44 is arranged in a manner opposed to the photosensitive drum 40, and the inner space of the developing device 44 is partitioned by a partition wall 51 into a first chamber (developing chamber) 52 and a second chamber (stirring chamber) 53. A nonmagnetic developing sleeve 54 which rotates in a direction indicated by an arrow is arranged in the developing chamber 52, and a magnet 55 is fixedly disposed within the developing sleeve 54. The developing sleeve 54 conveys two-component developer composed of magnetic carrier particles and nonmagnetic toner particles (hereinafter simply referred to as the "toner"), within the developing chamber 52, by carrying it thereon in a state in which a layer thickness of the developer is regulated by a blade 56, and supplies the nonmagnetic toner particles to the photosensitive drum 40 from a developing area opposed to the photosensitive drum 40 to thereby develop an electrostatic latent image. To improve developing efficiency, i.e. a rate of toner added to an electrostatic latent image, a developing bias voltage obtained by superposing a DC voltage on an AC voltage is applied to the developing sleeve 54 from a power supply 57.

The developing chamber 52 and the stirring chamber 53 are provided with stirring screws 58 and 59, respectively. The stirring screw 58 stirs and conveys developer within the developing chamber 52. Further, the stirring screw 59 stirs and conveys the toner 63 supplied from the toner bottle 60 by rotating the conveying screw 62 provided in a toner discharge path 61, and two-component developer 43 already contained in the developing device 44, to thereby make uniform the ratio of toner in the developer (hereinafter referred to as the toner density). The partition wall 51 has near and far ends thereof, as viewed in FIG. 2, formed with respective developer passages (not shown) for communication between the developing chamber 52 and the stirring chamber 53. The stirring screws 58 and 59 move developer lowered in toner density due to development from the developing chamber 52 into the stirring chamber 53. Further, the stirring screws 58 and 59 move developer having recovered from the lowered toner density from the stirring chamber 53 into the developing chamber 52. This causes the developer contained within the developing device 44 to circulate through the two chambers formed by partitioning the same, i.e. the developing chamber 52 and the stirring chamber 53.

Referring again to FIG. 2, the image forming apparatus 1000 is provided with a transfer material bearing belt 47 supported by supporting rollers 45 and 46 located below the photosensitive drum 40. A transfer charger 49 is disposed at a location opposed to the photosensitive drum 40 via the transfer material bearing belt 47.

In the image forming apparatus having the above-described arrangement, an image of the original 31 to be copied is projected on the image pickup device 33, such as a CCD, by the lens 32. The image pickup device 33 separates the image of the original 31 into a large number of pixels, and generates a photoelectric conversion signal, corresponding to density of each pixel. An analog image signal output from the image pickup device 33 is sent to an image signal processing circuit 34, wherein the analog image signal is converted to a pixel image signal, on a pixel-by-pixel basis, which has an output level corresponding to a density of the pixel, and is sent to a pulse width modulation circuit 35. The pulse width modulation circuit 35 generates a laser driving pulse having a width (time duration) corresponding to the level of each input pixel image signal, and outputs the laser driving pulse.

Figure 3A:
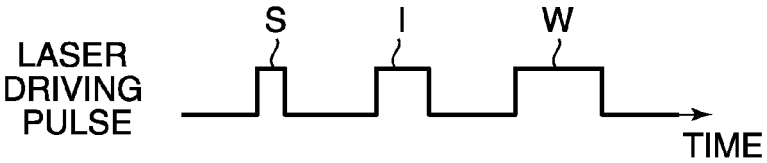
FIGS. 3A to 3D are waveform diagrams useful in explaining a method of counting density information of image data.

FIGS. 3A to 3D are waveform diagrams useful in explaining a method of counting density information of image data in the image forming apparatus shown in FIG. 1, in which FIG. 3A shows laser driving pulses generated by the pulse width modulation circuit 35 according to the level of the input pixel image signal. As shown in FIG. 3A, a laser driving pulse W having a larger width is generated in association with a higher-density pixel image signal, a laser driving pulse S having a smaller width is generated in association with a lower-density pixel image signal, and a laser driving pulse I having an intermediate width is generated in association with an intermediate-density pixel image signal.

Each of the laser driving pulses output from the pulse width modulation circuit 35 is supplied to the semiconductor laser 36, which is an exposure unit, to cause the semiconductor laser 36 to emit a laser beam over a time period corresponding to the width of the laser driving pulse. Therefore, the semiconductor laser 36 is driven for a longer time period for a higher-density pixel, and for a shorter time period for a lower-density pixel. Accordingly, the photosensitive drum 40 has a longer area exposed in a main scanning direction for the higher-density pixel, and has a shorter area exposed in the main scanning direction for the lower-density pixel. That is, the dot size of a pixel electrostatic latent image varies with the pixel density. FIG. 3D shows pixel electrostatic latent images formed according to the respective laser driving pulses shown in FIG. 3A. In forming the pixel electrostatic latent images L, M, and H shown in FIG. 3D, which correspond to the lower-density, intermediate-density, and higher-density pixels, respectively, as a matter of course, a larger amount of toner is consumed for higher-density pixels than for lower-density pixels.

A laser beam 36*a* emitted from the semiconductor laser 36 is swept by the rotary polygon mirror 37, and is formed into a spot image on the photosensitive drum 40, by the f/θ lens 38 and the fixed mirror 39 that orients the laser beam 36*a* toward the photosensitive drum 40. Thus, the laser beam 36*a* scans the photosensitive drum 40 in a direction substantially parallel to the rotational axis of the photosensitive drum 40 (main scanning direction), and thereby forms an electrostatic latent image on the surface of the photosensitive drum 40. Note that the exposure unit is not limited to the semiconductor laser 36, but may be any of other suitable light sources including an LED array.

The photosensitive drum 40 is an electrophotographic photosensitive drum including a layer of amorphous silicon, selenium, OPC (Organic Photo Conductor), or the like, formed on the surface thereof, and is rotated in a direction indicated by an arrow in FIGS. 1 and 2. The photosensitive drum 40 has static electricity thereon uniformly eliminated by the static eliminator 41, and is then uniformly charged by the primary charger 42. After that, as mentioned above, the photosensitive drum 40 is scanned and exposed by a laser beam modulated according to image data, whereby an electrostatic latent image corresponding to the image data is formed. The electrostatic latent image is reversely developed by the developing device 44, which is a developing unit, thereby being visualized into a toner image. Reversal development is a developing method that visualizes a latent image by attaching toner charged to the same polarity as the polarity of the latent image to a light-exposed area of the photosensitive member. The toner image on the photosensitive drum 40 is transferred onto a transfer material 48 held on the transfer material bearing belt 47 by the action of the transfer charger 49.

Note that in the image forming apparatus 1000 shown in FIG. 1, only one image forming station (including the photosensitive drum 40, the static eliminator 41, the primary charger 42, the developing device 44, and so on) is illustrated to simplify the description. However, in a case where the image forming apparatus is a color image forming apparatus, the image forming apparatus includes, for example, four image forming stations in association with the respective colors of cyan, magenta, yellow, and black, which are sequentially arranged in a manner opposed to the transfer material bearing belt 47 along the moving direction of the transfer material bearing belt 47. Electrostatic latent images of the respective colors, obtained by separating an image of an original into images of the respective colors, are sequentially formed on the photosensitive drums of the respective image forming stations, and are developed into respective toner images by the developing devices each having toner of an associated color, whereafter the toner images thus obtained are sequentially transferred onto the transfer material 48 which is held and conveyed by the transfer material bearing belt 47, to form a color toner image.

The transfer material 48 having a toner image transferred thereon is separated from the transfer material bearing belt 47, and is conveyed to a fixing device, not shown, wherein the toner image is fixed on the transfer material 48. The fixing device includes a heating roller having a heater and a pressing roller for pressing the heating roller, and applies heat and pressure to the transfer material 48 having the toner image formed thereon to thereby fix the toner image on the transfer material 48. Residual toner remaining on the photosensitive drum 40 after transferring the toner image is removed by the drum cleaner 50.

When toner in the developing device 44 is consumed in accordance with the above-described image forming processing, an amount of toner corresponding to a consumed amount of toner is supplied from the toner bottle 60 filled with toner to the developing device 44.

An inductance sensor 20 as a measurement unit is disposed on a bottom wall of the developing chamber 52 of the developing device 44. Here, the developer contained in the developing chamber 52 contains toner, and carrier having magnetic properties, as mentioned hereinabove. Therefore, as the ratio of toner to developer (toner density) in the developing chamber 52 increases, the ratio of carrier in the developer decreases. On the other hand, as the ratio of toner to developer (toner density) in the developing chamber 52 decreases, the ratio of carrier in the developer increases. The inductance sensor 20 detects magnetic permeability of the developer contained in the developing chamber 52, and outputs a signal corresponding to the toner density in the developing chamber 52. A CPU 67 included in a toner replenishment controller 1100 detects an amount of toner in the developer based on the signal output from the inductance sensor 20. Further, the image forming apparatus 1000 is provided with a counter 66. The counter 66 calculates a total sum of densities of respective pixels included in each page of image data, based on the signal output from the image signal processing circuit 34. The total sum of densities of respective pixels counted by the counter 66 (hereafter referred to as "the pixel count") corresponds to an amount of toner to be consumed from the developing device 44 for forming a toner image corresponding to one page portion of the image data.

Figure 3B:
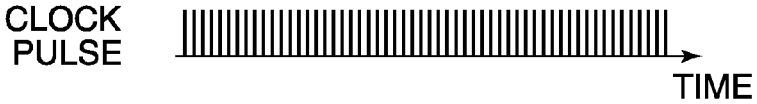
Figure 3C:
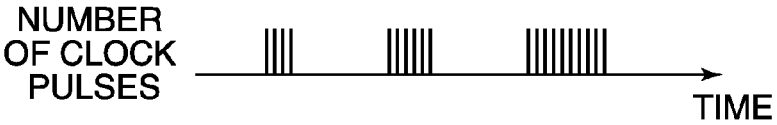
Figure 3D:
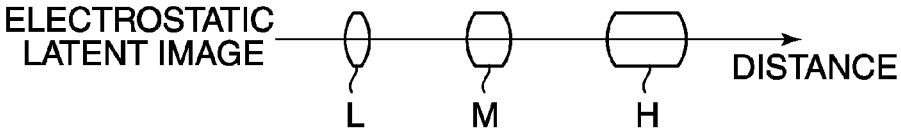

More specifically, a signal output from the pulse width modulation circuit 35 is supplied to one of the inputs of an AND gate 64, and clock pulses as shown in FIG. 3B are supplied from a clock pulse oscillator 65 to the other of the inputs of the AND gate 64. Therefore, clock pulses corresponding in number to the pulse width of each of the laser driving pulses S, I, and W, as shown in FIG. 3C, i.e. clock pulses corresponding in number to the density level of each pixel, are output from the AND gate 64. The number of clock pulses is added up by the counter 66 on a pixel-by-pixel basis, whereby the pixel count as an integrated value of the numbers of clock pulses, each counted on a pixel-by-pixel basis, is calculated. For example, the maximum pixel count of an A4-sized sheet is obtained by 3707×106. A pulse integration signal indicative of the pixel count of each image, calculated by the counter 66, corresponds to an amount of toner consumed from the developing device 44 for forming one toner image of the original 31. Besides the above-described type which operates in synchronism with the laser driving pulse, the counter 66 includes various types, such as a type that directly counts the number of pixels from image data, and any suitable one of them may be used.

In the developing device 44, the toner replenishment amount is determined based on the signal output from the inductance sensor 20 and the pixel count output from the counter 66, and the driving of a motor drive circuit 69 of the motor 70 which is a component element of a supply unit is controlled whenever image formation is performed. At this time, if the toner replenishment amount is larger, the motor 70 is driven for a longer time period, whereas if the toner replenishment amount is smaller, the motor 70 is driven for a shorter time period. The driving force of the motor 70 is transmitted to the conveying screw 62 via the gear train 71, and the conveying screw 62 conveys the toner 63 in the toner bottle 60, and supplies a predetermined amount of toner to the developing device 44.

Hereafter, a toner replenishment control process performed by the image forming apparatus shown in FIG. 1 will be described in detail with reference to drawings.

Figure 4:
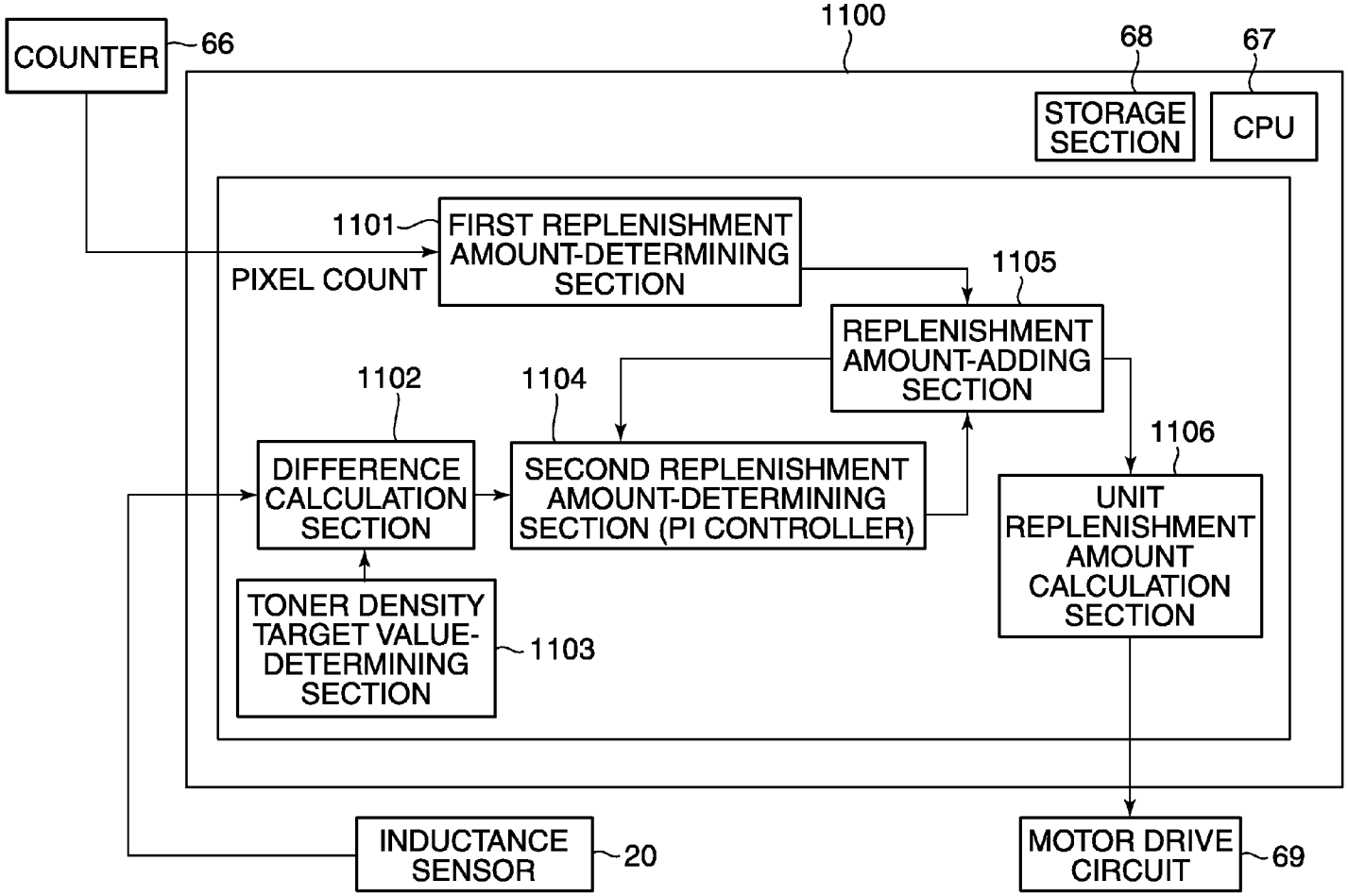
FIG. 4 is a control block diagram of a toner replenishment controller.

FIG. 4 is a block diagram of the toner replenishment controller 1100 of the image forming apparatus 1000 shown in FIG. 1. Referring to FIG. 4, the toner replenishment controller 1100 includes the CPU 67 and a storage section 68. Further, the toner replenishment controller 1100 includes a first replenishment amount-determining section 1101 and a difference calculation section 1102. The first replenishment amount-determining section 1101 receives the pixel count from the counter 66. The difference calculation section 1102 calculates a difference $\Delta D_n$ between the toner density $D_n$ in the developing chamber 52, detected by the inductance sensor 20, and a toner density target value $D_{ref}$, determined by a toner density target value-determining section 1103. The toner replenishment controller 1100 further includes a second replenishment amount-determining section (PI controller) 1104, a replenishment amount-adding section 1105, and a unit replenishment amount calculation section 1106. The unit replenishment amount calculation section 1106 calculates a unit replenishment amount, and outputs a toner replenishment signal for replenishment to the motor drive circuit 69.

Hereafter, the toner replenishment control process will be specifically described. The toner replenishment control process determines a toner replenishment amount, based on an amount of toner consumed from the developing device 44 by the image forming station for forming a toner image based on image data, and a toner density detected by the inductance sensor 20.

Figure 5:
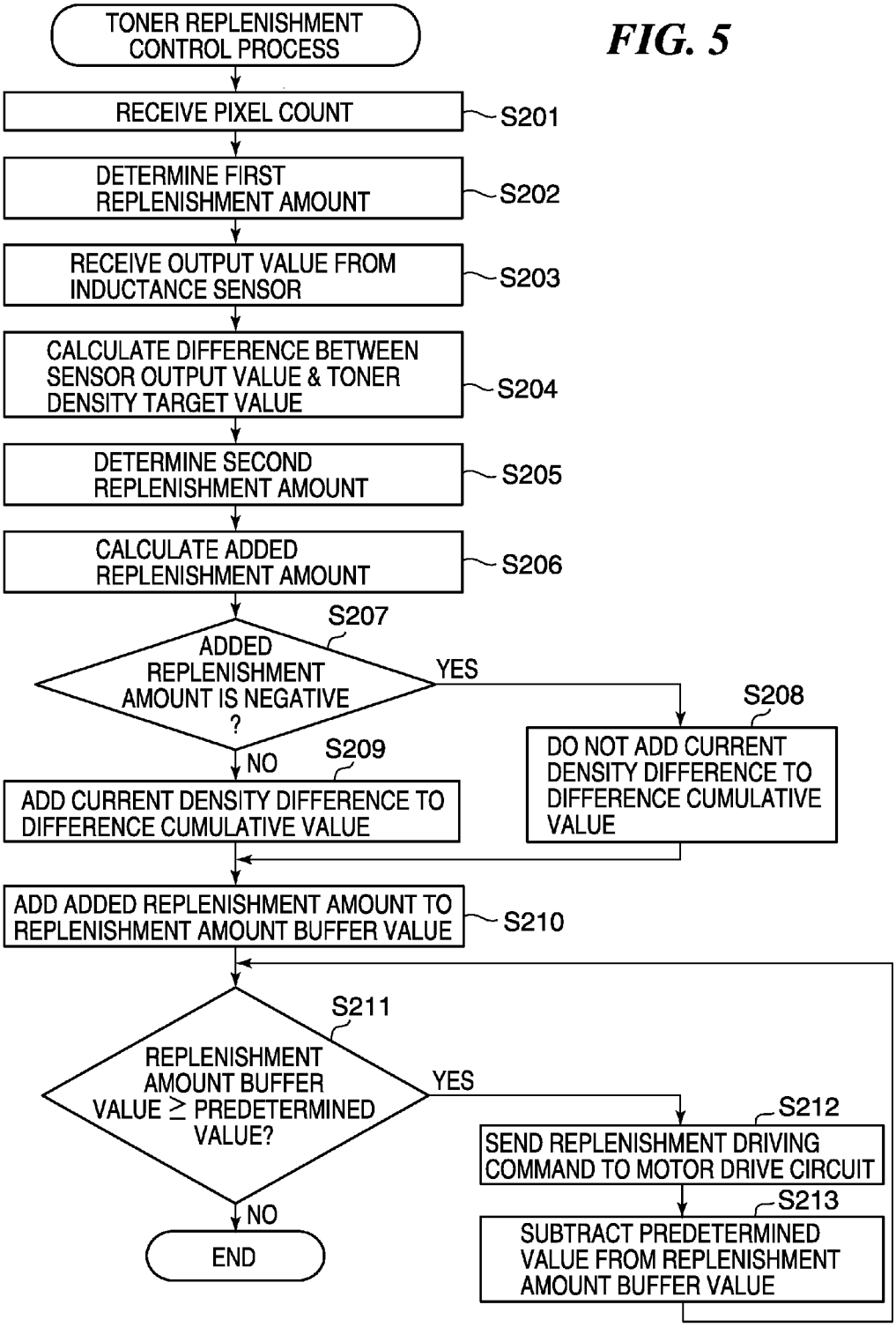
FIG. 5 is a flowchart of a toner replenishment control process.

FIG. 5 is a flowchart of the toner replenishment control process. The toner replenishment control process is performed by the CPU 67 of the toner replenishment controller 1100 of the image forming apparatus 1000 according to a toner replenishment control process program stored in a ROM, not shown. When image forming processing is started by the image forming apparatus 1000, toner is consumed, and the toner replenishment control process is started in accordance with toner consumption.

Referring to FIG. 5, when the toner replenishment control process is started, the CPU 67 controls the first replenishment amount-determining section 1101 to receive a pixel count from the counter 66 (step S201). Then, the CPU 67 controls the first replenishment amount-determining section 1101 to determine a first toner replenishment amount corresponding to an amount of toner to be consumed in the developing device 44 based on the input pixel count (step S202). In doing this, the first replenishment amount-determining section 1101 determines the first toner replenishment amount using the input pixel count and a conversion table prepared in advance to define a correspondence between pixel counts and toner replenishment time periods.

In the step S201, the counter 66 acquires the pixel count from a toner image or toner images of at least one or more pages included in image data, on a page-by-page basis. Then, in accordance with timing at which the image forming station starts to form a toner image of each page, the counter 66 outputs the pixel count of the page to the toner replenishment controller 1100. That is, the counter 66 outputs the pixel count associated with the toner image of one page to be formed by the image forming stations to the toner replenishment controller 1100.

Then, the CPU 67 controls the difference calculation section 1102 to receive an output value corresponding to the toner density $D_n$ in the developing device 44 from the inductance sensor 20 at a time before forming a toner image of one page (step S203). Then, the CPU 67 controls the difference calculation section 1102 to convert the value output from the inductance sensor 20 to the toner density $D_n$ in the developing device 44, and calculates a difference $DD_n$ between the obtained toner density $D_n$ and a target value $D_{ref}$ determined by the toner density target value-determining section 1103 (step S204).

Here, when a toner image of an n-th page is formed, the difference $\Delta D_n$ between the toner density $D_n$ detected by the inductance sensor 20 and the target value $D_{ref}$ is calculated by the following equation (1):

$$\Delta D_n = D_n - D_{ref} \quad (1)$$

wherein n represents a page number.

The toner density target value-determining section 1103 determines the target value $D_{ref}$ based on the temperature and humidity of the environment of the image forming apparatus, detected by an environment sensor, not shown, disposed on the image forming apparatus.

Then, in a step S205, the CPU 67 controls the second replenishment amount-determining section 1104 to calculate a sum of a value obtained by multiplying the difference $\Delta D_n$ which is calculated by the difference calculation section 1102 at the time of image formation of the image of the n-th page by a predetermined gain, and a value obtained by multiplying the immediately preceding value $\Sigma\Delta D_{n-1}$ of a difference cumulative value by a predetermined gain, by the following equation (2):

second replenishment amount=

$$(\alpha \times \Delta D_n) + (\beta \times \Sigma\Delta D_{n-1}) \quad (2)$$

wherein $\alpha$ and $\beta$ are both positive values smaller than 1 and represent values of the gains determined by experiment in advance. The thus calculated value is determined as a second toner replenishment value (step S205). The difference cumulative value $\Sigma\Delta D_n$ is determined in a step S208 or S209, referred to hereinafter.

Then, the CPU 67 controls the replenishment amount-adding section 1105 to calculate a sum of the first toner replenishment amount and the second toner replenishment amount, and sets the calculated sum as an added replenishment amount (step S206). This added replenishment amount is added to a replenishment amount buffer value in a step S210, referred to hereinafter, and if the replenishment amount buffer value is not smaller than a predetermined value, a replenishment operation for supplying toner from the toner bottle 60 to the developing device 44 by rotation of the conveying screw 62 is started.

Here, in a case where an image which consumes a very small amount of toner is formed in a state in which the toner density in the developing device is higher than the target value, the second replenishment amount becomes a negative value, and hence the added replenishment amount also becomes a negative value. In a case where images which consume a very small amount of toner are continuously formed, the added replenishment amount which is a negative value is added to the replenishment amount buffer value, page by page, and hence the replenishment amount buffer value becomes a large negative value. This causes a problem that in a case where an image which consumes a very large amount of toner is formed after the images consuming a very small amount of toner have been continuously formed, even though the added replenishment amount is a positive value, the replenishment amount buffer value does not become equal to or larger than the predetermined value, and hence the replenishment operation is not started.

To solve this problem, the toner replenishment control process in FIG. 5 is configured such that in a case where an image consuming a very small amount of toner is formed in a state in which the toner density in the developing device is higher than the target value, the replenishment amount buffer value is prevented from being reduced.

To this end, after the added replenishment amount is calculated in the step S206, the CPU 67 determines whether or not the added replenishment amount is a negative value (step S207). If it is determined in the step S207 that the added replenishment amount is a negative value, the CPU 67 controls the second replenishment amount-determining section 1104 to hold the difference cumulative value $\Sigma\Delta D$ without adding the difference $\Delta D_n$ to the immediately preceding value $\Sigma\Delta D_{n-1}$ of the difference cumulative value (step S208). That is, in the step S208, the second replenishment amount-determining section 1104 sets the immediately preceding value $\Sigma\Delta D_{n-1}$ of the difference cumulative value as the current value $\Sigma\Delta D_n$.

In the step S208, since the CPU 67 does not perform processing for accumulating the difference, even in a case where images consuming a very small amount of toner are continuously formed in the state in which the toner density in the developing device is higher than the target value, it is possible to prevent the replenishment amount buffer value from being reduced.

On the other hand, if it is determined in the step S207 that the added replenishment amount is not a negative value, the CPU 67 controls the second replenishment amount-determining section 1104 to add the difference $\Delta D_n$ to the immediately preceding value $\Sigma\Delta D_{n-1}$ of the difference cumulative value (step S209). That is, in the step S209, the second replenishment amount-determining section 1104 sets a sum of the immediately preceding value $\Sigma\Delta D_{n-1}$ of the cumulative value and the difference $\Delta D_n$ as the present value $\Sigma\Delta D_n$ of the difference cumulative value.

In the step S207, the added replenishment amount functions as a reference value with reference to which it is determined whether to update the difference cumulative value $\Sigma\Delta D_n$ by adding the difference $\Delta D_n$ calculated at a first timing to the immediately preceding value $\Sigma\Delta D_{n-1}$ thereof at the first timing, or update the cumulative value $\Sigma\Delta D_n$ without adding the difference $\Delta D_n$. After the second replenishment amount-determining section 1104 has set the difference cumulative value $\Sigma\Delta D_n$ in the step S208 or S209, the CPU 67 controls the unit replenishment amount calculation section 1106 to add the added replenishment amount to the replenishment amount buffer value (step S210). Note that the difference cumulative value $\Sigma\Delta D_n$ is used in calculation for determining the added replenishment amount in the next toner replenishment control process. The timing at which the next toner replenishment control process is performed corresponds to a second timing which is later than the first timing.

The CPU 67 determines whether or not the replenishment amount buffer value calculated in the step S210 is not smaller than a predetermined value (step S211). The predetermined value is stored e.g. in a ROM, not shown, in advance. In the present toner replenishment control process, the predetermined value is set to, for example, the same value as a defined replenishment amount of toner which is supplied to the developing device 44 from the toner bottle 60 at one time by one rotation of the conveying screw 62 (hereinafter sometimes also referred to as the "unit replenishment amount"), that is, a nominal replenishment amount supplied by one replenishment operation (per one screw rotation), but it may be set to a different value.

If it is determined in the step S211 that the replenishment amount buffer value is not smaller than the predetermined value, the CPU 67 proceeds to a step S212, and sends a drive command to the motor drive circuit 69 (step S212). Upon receipt of the drive command (toner replenishment signal in the on state), the motor drive circuit 69 drives the motor 70 such that the conveying screw 62 is caused to perform one rotation. As a consequence, the conveying screw 62 supplies toner from the toner bottle 60 to the developing device 44 by an amount corresponding to one replenishment operation (unit replenishment amount).

Then, the CPU 67 subtracts the predetermined value from the replenishment amount buffer value (step S213), and proceeds to the step S211. That is, in the steps S211 to S213, the CPU 67 supplies toner from the toner bottle 60 to the developing device 44 until the replenishment amount buffer value becomes smaller than the predetermined value. If it is determined in the step S211 that the replenishment amount buffer value is smaller than the predetermined value, the CPU 67 terminates the toner replenishment control process in FIG. 5.

According to the toner replenishment control process in FIG. 5, an amount of toner to be consumed (hereinafter also referred to as "toner consumption amount") is calculated based on the pixel count, and the calculated toner consumption amount is set as the first toner replenishment amount. Further, the actual measurement value of the toner density in the developing device 44 is obtained based on the output from the inductance sensor 20, and the second replenishment amount is determined based on the obtained actual measurement value and the target value. Then, when the replenishment amount buffer value obtained by accumulating the added replenishment amount calculated from the first replenishment amount and the second replenishment amount becomes equal to the predetermined value (the unit replenishment amount), toner replenishment from the toner bottle 60 is executed. This makes it possible to maintain the toner density in the developing chamber 52 of the developing device 44 at a level not lower than the predetermined value.

According to the above-described toner replenishment control, the difference cumulative value $\Sigma\Delta D$ is prevented from being calculated through excessive accumulation, whereby it is possible to smoothly converge the toner density in the developing device to the target value without causing overshoot, and thereby always maintain preferable image formation.

In the toner replenishment control process in FIG. 5, if the added replenishment amount obtained when one page of a toner image is to be formed is smaller than a threshold value (set to 0 in this example), the CPU 67 is configured to cause the second replenishment amount-determining section 1104 to stop calculation of the difference cumulative value $\Sigma\Delta D$. However, this is not limitative, but the CPU 67 may be otherwise configured insofar as it can prevent the second replenishment amount-determining section 1104 from adding the difference to the cumulative value. For example, if the added replenishment amount obtained when one page of a toner image is to be formed is smaller than the threshold value, the CPU 67 may cause the second replenishment amount-determining section 1104 to update the difference cumulative value $\Sigma\Delta D$ by setting the value of the difference to 0. Note that the threshold value to be compared with the added replenishment amount is not limited to 0.

Hereafter, a description will be given of a bottle near-end determination process for determining the replacement time of the toner bottle 60, performed by the image forming apparatus according to a first embodiment.

Figure 6:
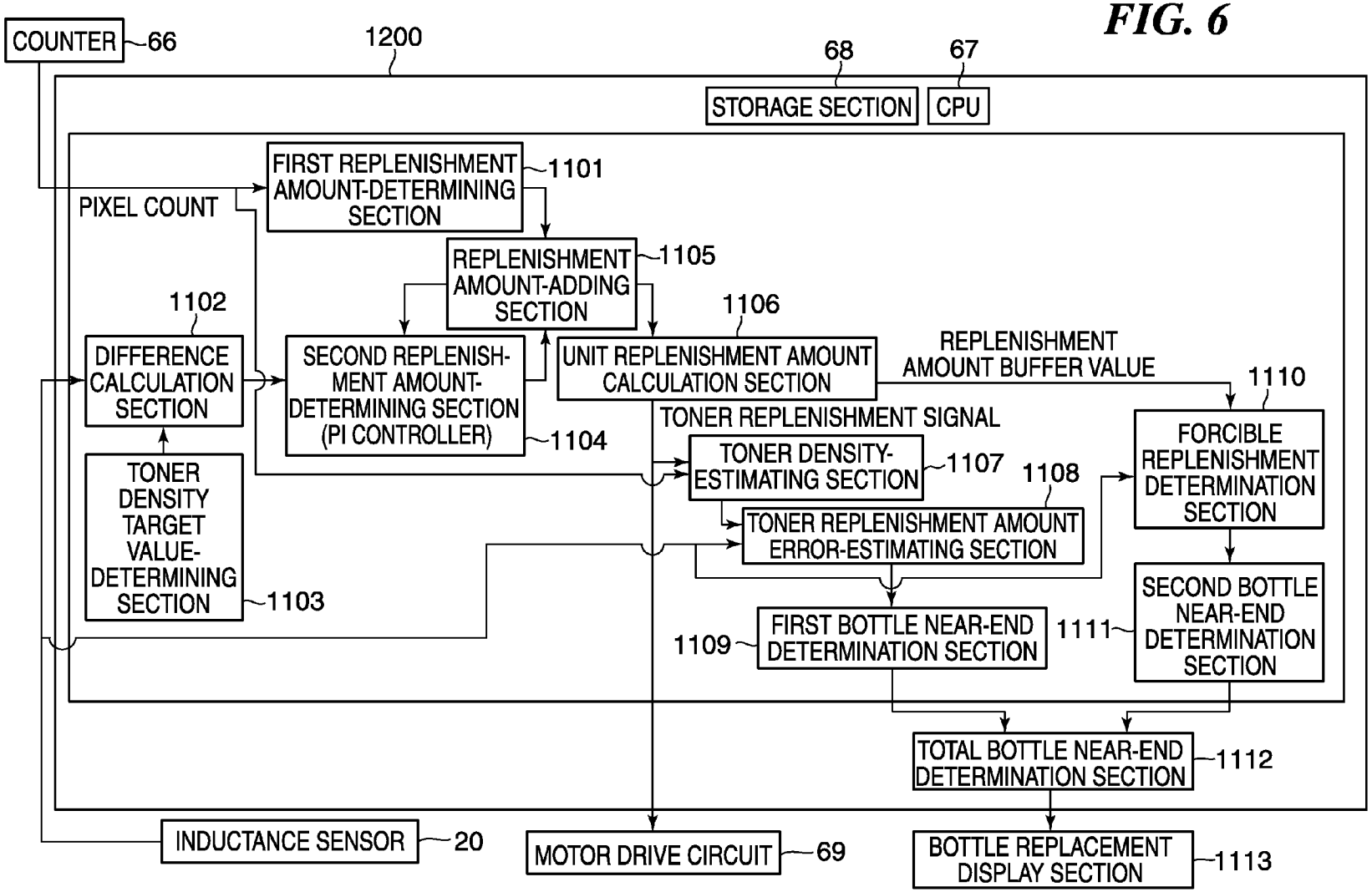
FIG. 6 is a control block diagram of a toner replenishment controller of an image forming apparatus according to a first embodiment.

FIG. 6 is a block diagram of a toner replenishment controller of the image forming apparatus according to the first embodiment. Referring to FIG. 6, this toner replenishment controller, denoted by reference numeral 1200, differs from the toner replenishment controller 1100, shown in FIG. 4, in that a toner density-estimating section 1107, a toner replenishment amount error-estimating section 1108, and a forcible replenishment determination section 1110 are additionally provided. Further, the toner replenishment controller 1200 differs from the toner replenishment controller 1100, shown in FIG. 4, also in that first and second bottle near-end determination sections 1109 and 1111, a total bottle near-end determination section 1112, and a bottle replacement display section 1113 are additionally provided.

Hereafter, the bottle near-end determination process performed by the CPU 67 of the toner replenishment controller 1200, shown in FIG. 6, will be described.

Figure 7:
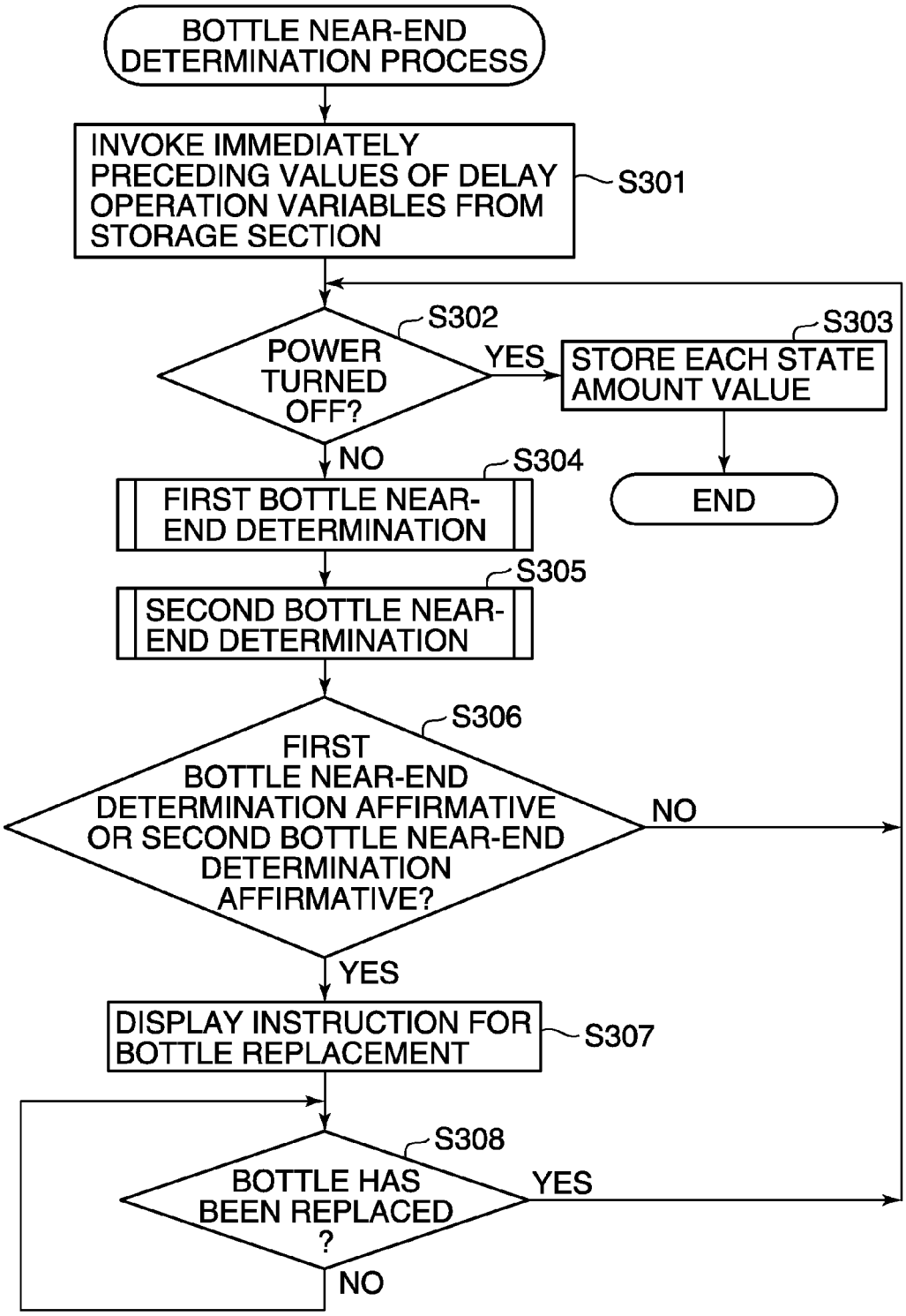
FIG. 7 is a flowchart of a bottle near-end determination process performed by the toner replenishment controller shown in FIG. 6.

FIG. 7 is a flowchart of the bottle near-end determination process. This bottle near-end determination process is a process for determining whether or not replacement of the toner bottle 60 is required so as to supply sufficient toner, and the bottle near-end determination process is performed by the CPU 67 of the toner replenishment controller 1200 shown in FIG. 6 through execution of a bottle near-end determination process program stored in a ROM, not shown. The term "bottle near-end" means the "replacement time of the toner bottle immediately before the bottle becomes empty". The bottle near-end determination process in FIG. 7 is repeatedly executed at intervals of e.g. 0.1 seconds.

Referring to FIG. 7, when the power of the image forming apparatus 1000 is turned on, the bottle near-end determination process is started. When the bottle near-end determination process is started, first, the CPU 67 invokes the immediately preceding values of delay operation variables from the storage section 68 (step S301). This is to continuously execute the present bottle near-end determination process after the preceding execution of the bottle near-end determination process. It is to be understood that when the power of the image forming apparatus 1000 is turned on for the first time, a predetermined value of each delay operation variable is invoked from the storage section 68.

Then, the CPU 67 determines whether or not the power of the image forming apparatus 1000 is turned off (step S302). If the power of the image forming apparatus 1000 is not turned off (NO to the step S302), the CPU 67 controls the first bottle near-end determination section 1109 to perform first bottle near-end determination (step S304). After performing the first bottle near-end determination, the CPU 67 controls the second bottle near-end determination section 1111 to perform second bottle near-end determination (step S305). Then, the CPU 67 controls the total bottle near-end determination section 1112 to determine whether it is determined by the first bottle near-end determination that the toner bottle 60 is in the bottle near-end state or it is determined by the second bottle near-end determination that the toner bottle 60 is in the bottle near-end state (step S306).

If it is determined in the step S306 that it is determined by both the first and second bottle near-end determinations that the toner bottle 60 is not in the bottle near-end state (NO to the step S306), the CPU 67 returns to the step S302. If it is determined in the step S306 that it is determined by the first or second bottle near-end determination that the toner bottle 60 is in the bottle near-end state (YES to the step S306), the CPU 67 displays an instruction for replacing the toner bottle 60 on the bottle replacement display section 1113 (step S307). Then, the CPU 67 determines whether or not the toner bottle 60 has been replaced, and waits until the toner bottle 60 is replaced (step S308). If it is determined in the step S308 that the toner bottle 60 has been replaced (YES to the step S308), the CPU 67 returns to the step S302, and repeats the above-described process until the power of the image forming apparatus 1000 is turned off.

Further, if it is determined in the step S302 that the power of the image forming apparatus 1000 is turned off (YES to the step S302), the CPU 67 stores each state amount value in the storage section 68 (step S303), followed by terminating the present process.

According to the bottle near-end determination process in FIG. 7, the near-end state of the toner bottle 60 is determined by the first or second bottle near-end determination, and if it is determined by either of the determinations that the toner bottle 60 is in the near-end state, the bottle replacement instruction is displayed. This makes it possible to properly determine the bottle near-end state of the toner bottle, and instructs the user to replace the toner bottle 60 with a new toner bottle.

Next, the first bottle near-end determination process performed in the step S304 of the bottle near-end determination process in FIG. 7 will be described.

Figure 8:
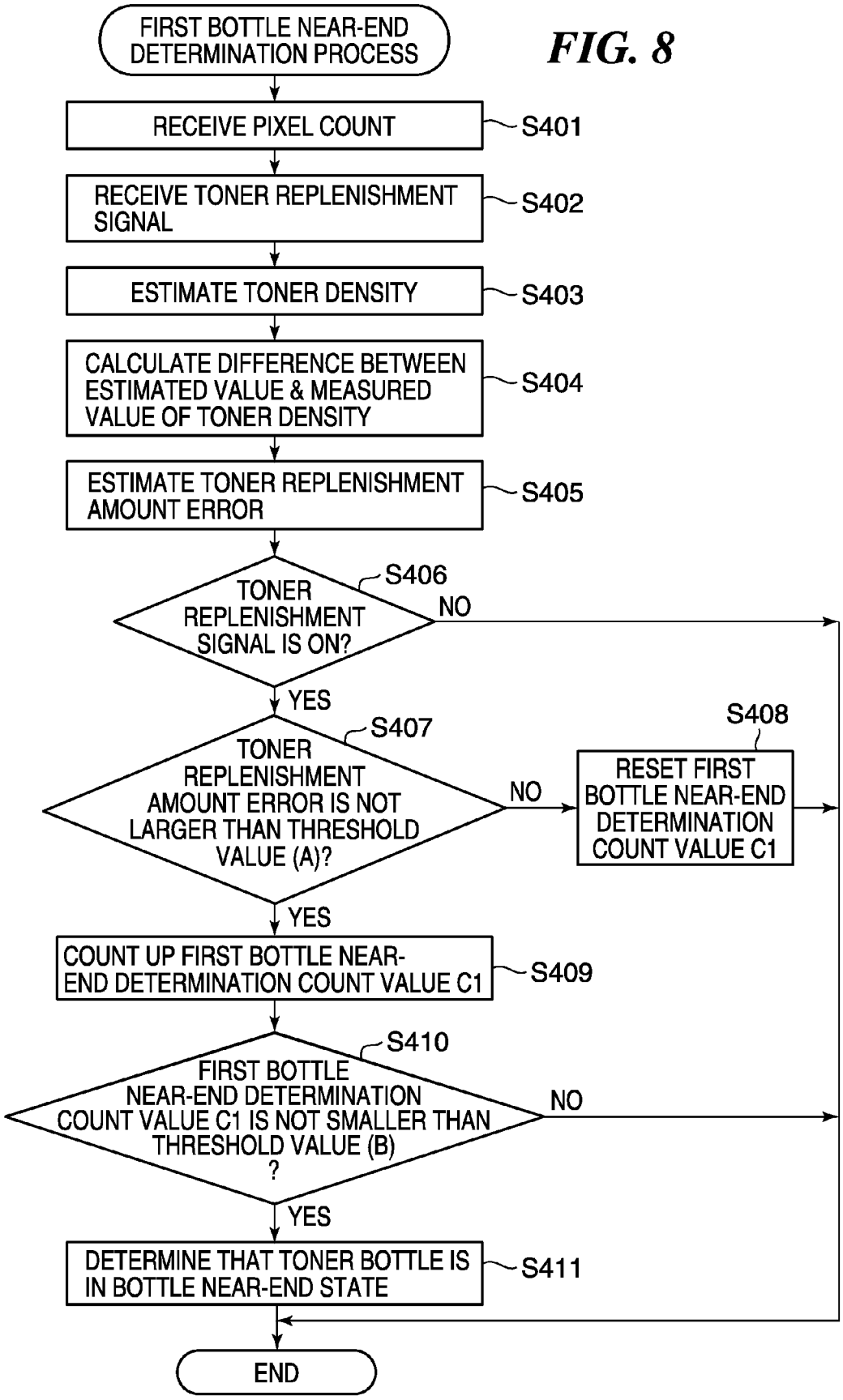
FIG. 8 is a flowchart of a first bottle near-end determination process performed in a step of the bottle near-end determination process in FIG. 7.

FIG. 8 is a flowchart of the first bottle near-end determination process performed in the step S304 of the bottle near-end determination process in FIG. 7. The first bottle near-end determination process is performed by the CPU 67 of the toner replenishment controller 1200 shown in FIG. 6 through execution of a first bottle near-end determination process program stored in the ROM, not shown. The first bottle near-end determination process is repeatedly executed during execution of the image forming processing at intervals of e.g. 0.1 seconds.

Referring to FIG. 8, when the first bottle near-end determination process is started, the CPU 67 controls the toner density-estimating section 1107 to receive a pixel count from the counter 66 (step S401). Further, the CPU 67 waits until a toner replenishment signal is received from the unit replenishment amount calculation section 1106 (step S402). The toner replenishment signal is a signal sent to the motor drive circuit 69. The motor drive circuit 69 (see FIG. 1) causes the conveying screw 62 to perform one rotation. The toner replenishment signal is a drive command signal for causing toner to be supplied from the toner bottle 60.

Then, the CPU 67 controls the toner density-estimating section 1107 to estimate a toner density as a developer density in the developing device 44 based on the pixel count and the toner replenishment signal (step S403). The pixel count corresponds to an amount of toner to be consumed. Therefore, the amount of toner to be consumed can be calculated based on the pixel count with reference to the toner consumption amount per unit pixel count. On the other hand, the toner replenishment signal corresponds to an amount of toner to be supplied. That is, for the toner bottle 60, a nominal value of the toner replenishment amount per one rotation of the conveying screw 62 is defined, and an amount of toner to be supplied can be calculated based on the toner replenishment signal with reference to the nominal value.

Therefore, the toner density in the developing device 44 can be estimated from a difference between the toner consumption amount calculated based on the pixel count and the toner replenishment amount calculated based on the toner replenishment signal. When the toner replenishment amount is more than the toner consumption amount, the toner density in the developing device 44 becomes higher, whereas when the toner replenishment amount is less than the toner consumption amount, the toner density in the developing device 44 becomes lower.

After estimating the toner density in the developing device 44 (step S403), the CPU 67 controls the toner replenishment amount error-estimating section 1108 to calculate a difference between the estimated toner density and a toner density corresponding to an output value from the inductance sensor 20 (step S404). The inductance sensor 20 is a sensor which outputs a measurement value corresponding to the actual toner density in the developing device 44. Therefore, the difference obtained in the step S404 corresponds to a difference between the estimated value and the actual measurement value of the toner density in the developing device 44.

Then, the CPU 67 controls the toner replenishment amount error-estimating section 1108 to estimate a toner replenishment amount error based on the difference between the estimated value and the actual measurement value of the toner density (step S405).

The toner replenishment amount error is defined as follows: The toner density-estimating section 1107 uses the nominal toner replenishment amount per one rotation of the conveying screw 62 as the reference toner replenishment amount in calculating the amount of toner to be supplied. However, the actual toner bottle has variation in the toner replenishment amount per one rotation of the conveying screw 62. As a specific index for representing variation in toner replenishment amount, a difference between the nominal toner replenishment amount per one rotation of the conveying screw 62 and the actual toner replenishment amount is used. This difference is defined as the toner replenishment amount error (developer replenishment amount error). Note that as the toner replenishment amount error, there may be used a ratio of the actual measurement value of the toner density to the estimated value of the same.

The toner replenishment amount error is equal to 0 if the nominal toner replenishment amount is equal to the actual toner replenishment amount, and is a negative value or a positive value if the actual toner replenishment amount is less or more than the nominal toner replenishment amount. Incidentally, the toner replenishment amount error of the toner bottle 60 is responsible for the above-mentioned difference between the estimated value and the actual measurement value of the toner density. Therefore, the toner replenishment amount error per one rotation of the conveying screw 62 can be estimated based on the difference between the estimated toner density and the actually measured toner density, and the number of rotations of the conveying screw 62 driven for supplying an amount of toner corresponding to the toner consumption amount calculated based on the pixel count. As the absolute value of the difference between the estimated value and the actual measurement value of the toner density is larger, the absolute value of the toner replenishment amount error is larger.

After estimating the toner replenishment amount error (step S405), the CPU 67 controls the first bottle near-end determination section 1109 to perform the toner bottle near-end determination using the estimated toner replenishment amount error.

When the toner replenishment amount error is a small negative value, this indicates that the toner replenishment amount per one rotation of the conveying screw 62 is smaller than the nominal value. As the toner bottle 60 becomes closer to the bottle near-end state, the amount of toner in the toner bottle 60 is reduced. Therefore, in a case where the remaining amount of toner in the toner bottle 60 is smaller than a predetermined amount, the toner replenishment amount per one rotation of the conveying screw 62 is progressively reduced. Based on this characteristic that the toner replenishment amount is reduced as described above, the bottle near-end determination is performed.

Specifically, first, the CPU 67 determines whether or not the toner replenishment signal is on (step S406). This is because the toner bottle 60 becomes close to the near-end state in accordance with execution of the toner replenishment control process. If it is determined in the step S406 that the toner replenishment signal is on (YES to the step S406), the CPU 67 determines whether or not the toner replenishment amount error estimated in the step S405 is not larger than a predetermined threshold value (A) set in advance (step S407). This is because if the toner replenishment amount error is not larger than the predetermined threshold value (A), it is possible to determine that the toner bottle 60 becomes closer to the bottle near-end state. It is only required that the threshold value (A) is appropriately determined e.g. by experiment.

If it is determined in the step S407 that the toner replenishment amount error is not larger than the predetermined threshold value (A) (YES to the step S407), the CPU 67 counts up a first bottle near-end determination count value C1 (step S409). This counting is performed in order to determine the frequency of outputting of a result for determination of the bottle near-end state.

Then, the CPU 67 determines whether or not the first bottle near-end determination count value C1 has reached a threshold value (B) set in advance, i.e. whether or not the first bottle near-end determination count value C1 is equal to or larger than the threshold value (B) (step S410). If it is determined in the step S410 that the first bottle near-end determination count value C1 is equal to or larger than the threshold value (B) set in advance (YES to the step S410), the CPU 67 determines that the toner bottle 60 is in the near-end state (step S411), followed by terminating the present process. It is only required that the threshold value (B) is appropriately determined e.g. by experiment.

On the other hand, if it is determined in the step S406 that the toner replenishment signal is not on (NO to the step S406), the CPU 67 terminates the present process. This is because unless toner is supplied, the toner bottle 60 does not become the near-end state, and it is unnecessary to perform the bottle near-end determination. Further, if it is determined in the step S407 that the toner replenishment amount error is larger than the predetermined threshold value (A) (NO to the step S407), the CPU 67 resets the first bottle near-end determination count value C1 (step S408), followed by terminating the present process. This is because if the toner replenishment amount error is larger than the predetermined threshold value (A), it cannot be said that the toner bottle 60 is close to the bottle near-end state.

Further, if it is determined in the step S410 that the first bottle near-end determination count value C1 is smaller than the threshold value (B) set in advance (NO to the step S410), the CPU 67 terminates the present process without determining that the toner bottle 60 is in the bottle near-end state. If the count value C1 is smaller than the threshold value (B), it is unnecessary to replace the toner bottle 60.

According to the first bottle near-end determination process in FIG. 8, the toner density in the developing device 44 is estimated based on the pixel count and the toner replenishment signal (step S403), and the difference between the estimated toner density and the actual toner density determined based on the output value from the inductance sensor 20 is calculated (step S404). Further, the toner replenishment amount error is estimated based on the calculated difference (step S405). Then, in a case where the toner replenishment amount error becomes equal to or smaller than the predetermined threshold value (A), and also the frequency at which the toner replenishment amount error becomes equal to or smaller than the predetermined threshold value (A) is equal to or larger than the constant threshold value (B), it is determined that the toner bottle 60 is in the bottle near-end state. Therefore, it is possible to properly determine the bottle near-end state of the toner bottle 60.

Next, the second bottle near-end determination process performed in the step S305 of the bottle near-end determination process in FIG. 7 will be described.

FIG. 9 is a flowchart of the second bottle near-end determination process performed in the step S305 of the bottle near-end determination process in FIG. 7. The second bottle near-end determination process is performed by the CPU 67 of the toner replenishment controller 1200 shown in FIG. 6 through execution of a second bottle near-end determination process program stored in the ROM, not shown. The second bottle near-end determination process is repeatedly executed during execution of the image forming processing at intervals of e.g. 0.1 seconds.

Referring to FIG. 9, when the second bottle near-end determination process is started, the CPU 67 receives a detected value of the toner density in the developing device 44, which corresponds to an output value from the inductance sensor 20 (step S501). Then, the CPU 67 controls the forcible replenishment determination section 1110 to receive a replenishment amount buffer value from the unit replenishment amount calculation section 1106 (step S502). Then, the CPU 67 determines whether or not the current image formation mode is a forcible replenishment mode (step S503). The forcible replenishment mode is a mode for supplying toner in a state in which new image formation by the image forming section is interrupted to stop consumption of toner by image formation. In a case where the toner density in the developing device 44, which corresponds to a measurement result output from the inductance sensor 20, is not higher than a predetermined threshold value (C), this indicates that the amount of supplied toner has been less than the amount of consumed toner and hence lowering of the toner density in the developing device 44 has been caused. Therefore, it is necessary to interrupt image formation, and supply toner. It is only required that the threshold value (C) is appropriately determined e.g. by experiment.

Further, also in a case where the replenishment amount buffer value is not smaller than a predetermined threshold value (D), this indicates a state where the amount of toner supplied by the replenishment motor 70 is insufficient to the toner consumption amount, and the replenishment amount buffer value obtained by the toner replenishment control continues to be accumulated. Therefore, also in the case where the replenishment amount buffer value is not smaller than the predetermined threshold value (D), it is necessary to temporarily interrupt image formation and supply toner. More specifically, the replenishment motor 70 has restrictions in terms of hardware, which limit the number of times of toner replenishment operation per unit time period. For example, in a case where images which are high in toner density have been continuously formed, the added replenishment amount calculated by the replenishment amount-adding section 1105 increases at a higher rate than a rate corresponding to the limit of the number of times of toner replenishment operation, so that values of the added replenishment amount continue to be accumulated as the replenishment amount buffer value in the unit replenishment amount calculation section 1106, and eventually the replenishment amount buffer value exceeds the threshold value (D). When the replenishment amount buffer value thus exceeds the threshold value (D), image formation processing to be newly performed is once interrupted to thereby prevent a pixel count from being newly input, and in this state, the replenishment motor 70 is driven to supply toner. This makes it possible to reduce the replenishment amount buffer value in the unit replenishment amount calculation section 1106, whereby the toner replenishment is restored to a state in which the amount of toner supplied by the replenishment motor 70 becomes sufficient for the toner consumption amount. It is only required that the threshold value (D) is appropriately determined e.g. by experiment.

If it is determined in the step S503 that the image formation mode is not the forcible replenishment mode (NO to the step S503), the CPU 67 controls the forcible replenishment determination section 1110 to perform the following determination: The CPU 67 determines whether the toner density in the developing device 44, which corresponds to the output value from the inductance sensor 20, is not higher than the predetermined threshold value (C), or the replenishment amount buffer value is not smaller than the predetermined threshold value (D) (step S504). If it is determined in the step S504 that the toner density is not higher than the predetermined threshold value (C) or the replenishment amount buffer value is not smaller than the predetermined threshold value (D)(YES to the step S504), the CPU 67 shifts the mode to the forcible replenishment mode (step S505).

After shifting the mode to the forcible replenishment mode, or if it is determined in the step S503 that the mode is the forcible replenishment mode (YES to the step S503), the CPU 67 proceeds to a step S506, wherein the CPU 67 determines whether or not the toner density in the developing device 44, which corresponds to the output value from the inductance sensor 20, is higher than the predetermined threshold value (C), and also the replenishment amount buffer value has been restored to a value smaller than the predetermined threshold value (D). This is because the toner bottle 60 is not suspected to be in the bottle near-end state if the toner density is higher than the predetermined threshold value (C), and also the replenishment amount buffer value is smaller than the predetermined threshold value (D). If it is determined in the step S506 that the above-mentioned conditions are not satisfied even after replenishment of toner is performed a predetermined or larger number of times (NO to the step S506), the toner bottle 60 is suspected to be in the bottle near-end state. Therefore, the CPU 67 controls the second bottle near-end determination section 1111 to perform the bottle near-end determination (steps S509 to S514).

In doing this, if the toner bottle 60 is not in the bottle near-end state, and the toner replenishment amount per one rotation of the conveying screw 62 is close to the nominal value, and hence by supplying toner through driving the conveying screw 62 to cause the same to perform a predetermined number of rotations in the forcible replenishment mode, the toner density in the developing device 44, which corresponds to the value output from the inductance sensor 20, and the replenishment amount buffer value, are restored. However, if the toner bottle 60 is close to the bottle near-end state, so that the toner replenishment amount per one rotation of the conveying screw 62 is small, even when toner replenishment is performed by driving the conveying screw 62 to cause the same to perform a predetermined number of rotations, the total amount of toner replenishment is small. For this reason, the toner density in the developing device 44, which corresponds to the output value from the inductance sensor 20, and the replenishment amount buffer value are not restored. Therefore, in a case where the toner density corresponding to the output value from the inductance sensor 20 and the replenishment amount buffer value are not restored even if toner is supplied by driving the conveying screw 62 to cause the same to perform the predetermined number of rotations in the forcible replenishment mode, it can be determined that the toner bottle 60 is in the bottle near-end state. It is only required that the number of rotations of the conveying screw 62 by driving the same for determining that the toner bottle 60 is in the bottle near-end state is appropriately determined e.g. by experiment.

Referring again to FIG. 9, in the specific second bottle near-end determination, first, the CPU 67 determines whether or not the toner replenishment signal is on (step S509). This is because unless the toner replenishment control process is being performed, the toner bottle 60 does not become the near-end state. If it is determined in the step S509 that the toner replenishment signal is on (YES to the step S509), the CPU 67 counts up a second bottle near-end determination count value C2 (step S510).

Then, the CPU 67 determines whether or not the toner density in the developing device 44, which corresponds to the output value from the inductance sensor 20, is not lower than the predetermined threshold value (C) (step S511). If it is determined in the step S511 that the toner density in the developing device 44 is lower than the predetermined threshold value (C) (NO to the step S511), the CPU 67 determines whether or not the second bottle near-end determination count value C2 has reached a predetermined threshold value (E), i.e. whether or not the second bottle near-end determination count value C2 is not smaller than the predetermined threshold value (E) (step S513). If it is determined in the step S513 that the second bottle near-end determination count value C2 is not smaller than the predetermined threshold value (E) (YES to the step S513), the CPU 67 determines that the toner bottle 60 is in the bottle near-end state (step S514), followed by terminating the present process. It is only required that the threshold value (E) is appropriately determined e.g. by experiment.

On the other hand, if it is determined in the step S504 that the toner density is higher than the predetermined threshold value (C) or the replenishment amount buffer value is smaller than the predetermined threshold value (D) (NO to the step S504), the CPU 67 terminates the present process. This is because the possibility that the toner bottle 60 is in the bottle near-end is low. Further, if it is determined in the step S506 that the toner density is higher than the predetermined threshold value (C) and the replenishment amount buffer value is smaller than the predetermined threshold value (D) (YES to the step S506), the CPU 67 resets the second bottle near-end determination count value C2 (step S507). This is because the possibility that the toner bottle 60 is in the bottle near-end is low. Then, the CPU 67 cancels the forcible replenishment mode (step S508), followed by terminating the present process.

Further, if it is determined in the step S509 that the toner replenishment signal is not on (NO to the step S509), the CPU 67 terminates the present process. This is because unless toner is supplied, the toner bottle 60 does not become the near-end state, and it is unnecessary to execute the bottle near-end determination.

Further, if it is determined in the step S511 that that the toner density in the developing device 44, which corresponds to the output value from the inductance sensor 20, is not lower than the predetermined threshold value (C) (YES to the step S511), the CPU 67 proceeds to a step S512, wherein the CPU 67 once resets the second bottle near-end determination count value C2, followed by terminating the present process. This is because the possibility that the toner bottle 60 is in the bottle near-end is low.

According to the second bottle near-end determination process in FIG. 9, when the toner density in the developing device 44, which corresponds to the detected output value from the inductance sensor 20, is not higher than the predetermined threshold value (C), or the replenishment amount buffer value is not smaller than the predetermined threshold value (D), image formation to be newly performed is interrupted, and toner is supplied in the state in which toner consumption is stopped. This toner replenishment mode is the forcible replenishment mode. After shifting the mode to the forcible replenishment mode, if the measurement value output from the inductance sensor 20 is not restored, it is determined that the toner bottle 60 is in the bottle near-end state. This makes it possible to properly determine the bottle near-end state of the toner bottle 60 in the forcible replenishment mode.

In the present embodiment, only the first bottle near-end determination in FIG. 8 may be executed as the bottle near-end determination without using the second bottle near-end determination in FIG. 9. This also makes it possible to properly perform the bottle near-end determination.

In the present embodiment, an amount of driving the replenishment motor 70 which supplies toner in the toner bottle 60 to the developing device 44 or a time period over which the replenishment motor 70 is driven can also be controlled based on the toner replenishment amount error estimated by the toner replenishment amount error-estimating section 1108.

The following description will be given of advantageous effects provided by the present embodiment in comparison with effects provided by the conventional technique.

First, the effects provided by the conventional technique will be described with reference to FIGS. 10A and 10B.

Figure 10A:
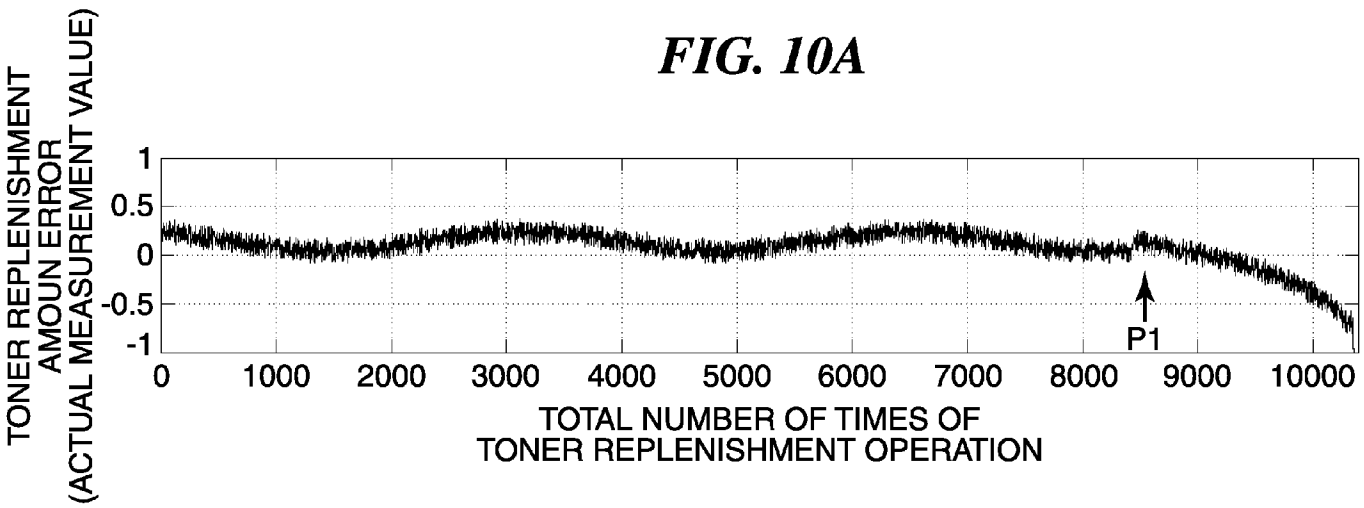
FIGS. 10A and 10B are diagrams useful in explaining effects provided by a conventional technique.
Figure 10B:
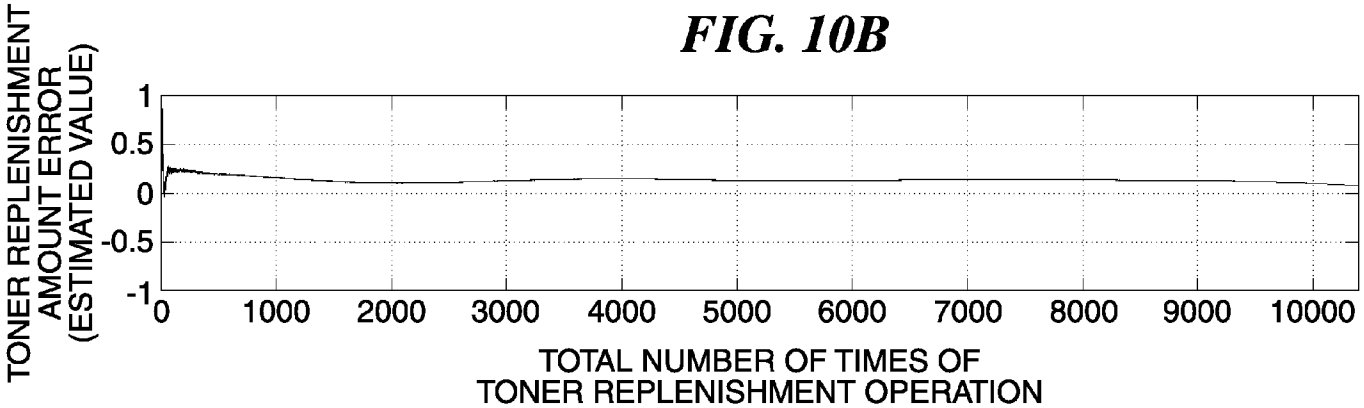

FIGS. 10A and 10B are diagrams useful in explaining the effects provided by the conventional technique. FIG. 10A shows changes in the actual measurement value of the toner replenishment amount error of a toner bottle occurring after toner bottle started to be used in a brand-new state thereof until it ceased to be used in an empty state thereof, and FIG. 10B shows changes in the estimated value of the toner replenishment amount error estimated by the conventional technique. In FIGS. 10A and 10B, the horizontal axis represents the total number of rotations of the conveying screw 62 caused by driving of the same (total number of times of toner replenishment operation), and the vertical axis represents the toner replenishment amount error.

In FIG. 10A, the actual measurement value of the toner replenishment amount error changes substantially around a value of 0 while undergoing long-term variations after the toner bottle started to be used in a brand-new state thereof until a point P1 is reached. The long-term variations are caused by the influence of a surrounding environment in which the image forming apparatus main unit is placed, and when temperature and humidity undergo long-term variations e.g. depending on the season, it is considered that the bottle replenishment amount error is also influenced by the changes in temperature and humidity. On the other hand, the toner replenishment amount error is progressively reduced when the total number of times of toner replenishment operation exceeds the point P1, and finally, the toner bottle 60 becomes empty to enter the bottle-end state.

In the conventional technique, the toner replenishment amount error is estimated based on the amount of change in the cumulative value of the toner replenishment amount with respect to the cumulative value of the pixel count calculated from image data. More specifically, the cumulative value of the pixel count and that of the toner replenishment amount from the start of use of the toner bottle 60 up to the time of estimation of the toner replenishment amount error are calculated. The toner replenishment amount is measured by counting the number of times of toner replenishment operation by the replenishment motor 70. An amount of change in the toner replenishment amount is calculated using the cumulative value of the toner replenishment amount with respect to the cumulative value of the pixel count from the start of use of the toner bottle 60 up to the present time, and the toner replenishment amount error is estimated using the amount of change. Then, the toner replenishment amount is increased or reduced according to the estimated toner replenishment amount error to stabilize the toner density.

The conventional technique described above is for determining an index indicating whether the toner replenishment amount error as totally checked over a predetermined time period is large or small with respect to a specific toner bottle, using the amount of change in the cumulative value of the pixel count and that of the toner replenishment amount from the start of use of the toner bottle up to the time of estimation of the replenishment amount error.

FIG. 10B shows the estimation result of the toner replenishment amount error determined by the above-described conventional technique. In FIG. 10B, although it is possible to estimate the average toner replenishment amount error up to the point P1 except long-term variations, it is impossible to estimate a characteristic that the toner replenishment amount error is progressively reduced toward the bottle end after the point P1. Therefore, in the conventional technique, it is impossible to properly perform the bottle near-end determination using the estimated toner replenishment amount error.

Figure 11A:
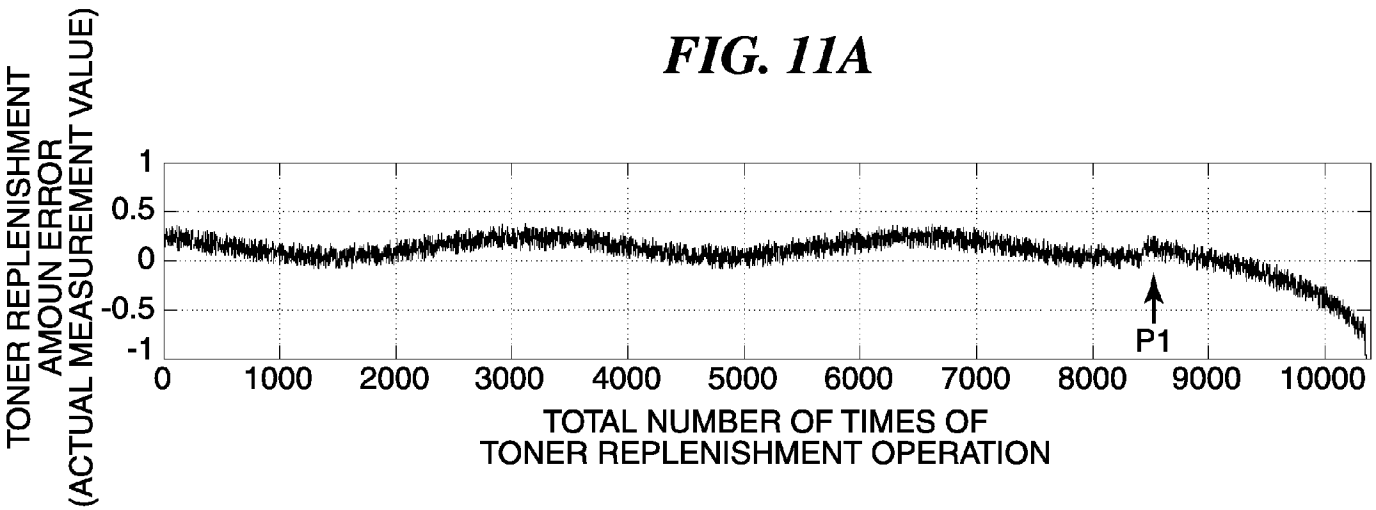
FIGS. 11A and 11B are a timing diagram useful in explaining advantageous effects provided by the first embodiment.
Figure 11B:
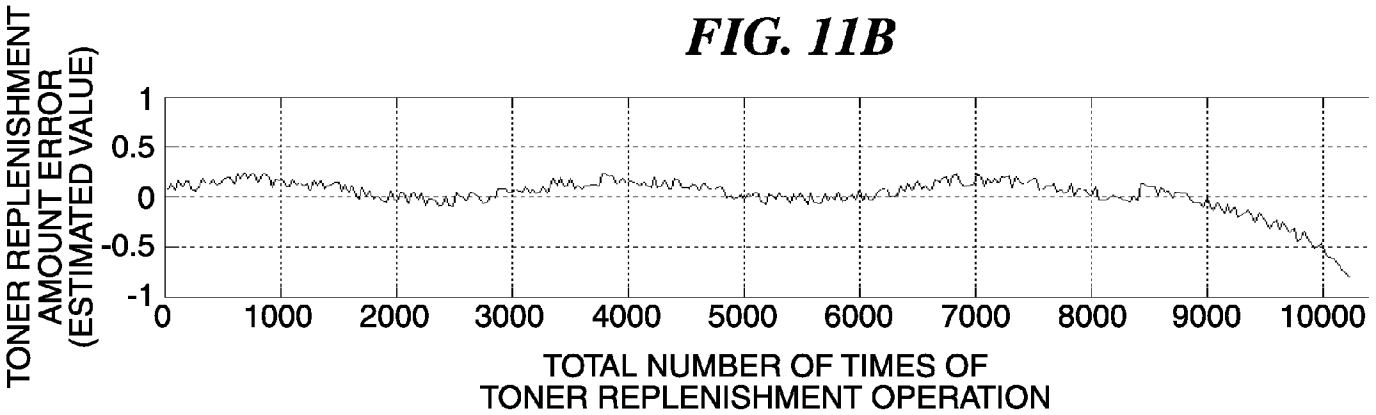

On the other hand, FIGS. 11A and 11B are diagrams useful in explaining the advantageous effects provided by the above-described embodiment.

FIG. 11B shows changes in the toner replenishment amount error estimated by the above-described embodiment. Note that, similar to FIG. 10A, FIG. 11A shows changes in the actual measurement value of the toner replenishment amount error of the toner bottle.

As shown in FIG. 11B, in the present embodiment, it is possible to follow long-term variations up to the point P1, and also follow the characteristic that the toner replenishment amount error is progressively reduced toward the bottle end after the total number of times of toner replenishment operation indicated by the vertical axis exceeds the point P1. In the present embodiment, the toner replenishment amount error is estimated by comparing a toner density which is sequentially estimated and an actual toner density which is detected by the inductance sensor 20. Therefore, it is also possible to follow reduction of the toner replenishment amount error which characteristically appears only after the point P1. As described above, by estimating the toner replenishment amount error in conformity with an actual measurement value of the toner density in the developing device 44, and performing the bottle near-end determination using the estimated toner replenishment amount error, it is possible to perform excellent bottle near-end determination in conformity with reality.

Next, a description will be given of another advantageous effect provided by the present embodiment which performs the first bottle near-end determination and the second bottle near-end determination.

The second bottle near-end determination section 1111 makes use of the characteristic that when the toner bottle 60 is in the bottle near-end state, the toner replenishment amount is reduced so that the toner density in the developing device 44, which corresponds to the output value from the inductance sensor 20, is lowered. That is, in a case where sheets are continuously passed to form intermediate-to-high density images, the amount of consumed toner is larger than the reduced toner replenishment amount, and hence the toner density corresponding to the output value from the inductance sensor 20 is also lowered without much delay from reduction of the toner replenishment amount error after the point P1. Therefore, it is possible to determine the bottle near-end state by the second bottle near-end determination section 1111.

On the other hand, in a case where sheets are continuously passed to form low-density images, the amount of consumed toner is also small with respect to the reduced toner replenishment amount after the point P1, and hence even when the toner replenishment amount error starts to be reduced after the point P1, the toner density corresponding to the output value from the inductance sensor 20 very slowly lowers. Therefore, when the bottle near-end determination is performed only by the second bottle near-end determination, the timing of determining the bottle near-end state is delayed. Particularly, in image forming apparatuses for office use, it often occurs that sheets are continuously passed to form low-density images, there is a demand for near-end determination which can cope with continuous sheet passing for low-density images.

Further, the second bottle near-end determination is made with reference to the fact that the toner density corresponding to the output value from the inductance sensor 20 becomes equal to or lower than the predetermined threshold value, and hence unless the toner density deviates from a target value, it is impossible to perform the bottle near-end determination. However, the state where the toner density deviates from the target value causes image density deviation. Therefore, it is desirable to perform the bottle near-end determination in a state in which the toner density does not deviate from the target value.

In the present embodiment, the first bottle near-end determination is performed using the estimated toner replenishment amount error, and hence it implies direct monitoring of the toner replenishment amount supplied from the toner bottle 60 for reduction thereof. Therefore, it is possible to perform the bottle near-end determination at a suitable timing independently of the density of an image to be formed on a sheet. Further, even if the toner density corresponding to the output value from the inductance sensor 20 does not become equal to or lower than the predetermined threshold value, i.e. even if the toner density does not deviate from the target value, it is possible to perform the bottle near-end determination.

As described above, in the present embodiment using the first bottle near-end determination and the second bottle near-end determination in combination, it is possible to properly perform the bottle near-end determination of a toner bottle.

Hereafter, a description will be given of a variation of the toner replenishment control performed by the first embodiment. In this variation, the toner replenishment amount error estimated by the toner replenishment amount error-estimating section 1108 is applied to the toner replenishment control.

Figure 12:
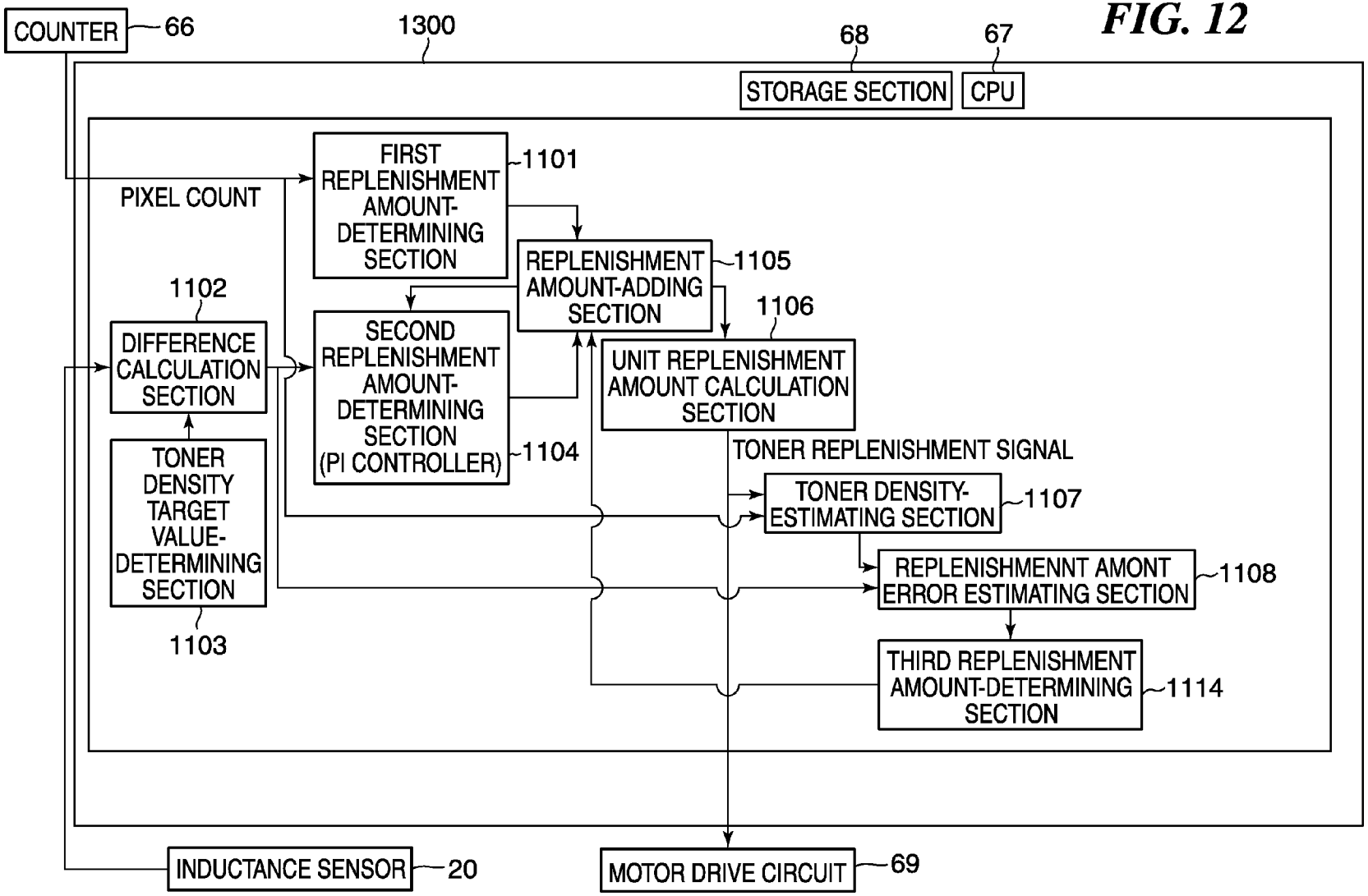
FIG. 12 is a control block diagram of a variation of the toner replenishment controller of the image forming apparatus according to the first embodiment.

FIG. 12 is a control block diagram of the variation of the toner replenishment controller of the image forming apparatus according to the first embodiment. Referring to FIG. 12, the toner replenishment controller, denoted by reference numeral 1300, differs from the toner replenishment controller 1200 shown in FIG. 6 in the following points: Differently from FIG. 6, replenishment amount error estimated by the toner replenishment amount error-estimating section 1108 is input to a third replenishment amount-determining section 1114, and a third replenishment amount determined by the third replenishment amount-determining section 1114 is input to the replenishment amount-adding section 1105, whereas the forcible replenishment determination section 1110, the first and second bottle near-end determination sections 1109 and 1111, the total bottle near-end determination section 1112, and the bottle replacement display section 1113 are omitted.

In the toner replenishment controller 1200 according to the embodiment, the replenishment amount-adding section 1105 determines an added value of the replenishment amount based on the inputs of the pixel count corresponding to the consumed amount of toner and the output value from the inductance sensor 20, which corresponds to the toner density in the developing device 44, and the toner replenishment control is performed using the added value. Therefore, the toner replenishment amount error associated with the amount of toner to be supplied is not taken into account in the toner replenishment control. However, the toner density in the developing device 44 is influenced by the ratio of the amount of supplied toner to the amount of consumed toner. Therefore, by also inputting the estimated value of the toner replenishment amount error to the replenishment amount-adding section 1105 for calculation of the added replenishment amount, it is possible to realize the toner replenishment control while taking into account variation in the amount of toner to be supplied.

More specifically, using the toner replenishment amount error estimated by the toner replenishment amount error-estimating section 1108, the third toner replenishment amount in which variation in the toner replenishment amount is taken into account is determined by the third replenishment amount-determining section 1114. Then, three replenishment amounts respectively determined by the first replenishment amount-determining section 1101, the second replenishment amount-determining section 1104, and the third replenishment amount-determining section 1114 are added by the replenishment amount-adding section 1105, and the thus determined value is output to the unit replenishment amount calculation section 1106 as the added replenishment amount. This makes it possible to adjust an amount of driving the replenishment motor 70 which supplies toner in the toner bottle 60 to the developing device 44 or a time period over which the replenishment motor 70 is driven, while taking into account variation in the amount of toner to be supplied, and thereby realize more practical toner replenishment control.

Next, a description will be given of an image forming apparatus according to a second embodiment of the present invention. The image forming apparatus according to the second embodiment has the same hardware configuration including the configuration of the developing device 44 shown in FIG. 2 as that of the image forming apparatus shown in FIG. 1, and hence illustration thereof is omitted. Components corresponding to those of the image forming apparatus shown in FIG. 1 are denoted by the same reference numerals, and description thereof is omitted.

Figure 13:
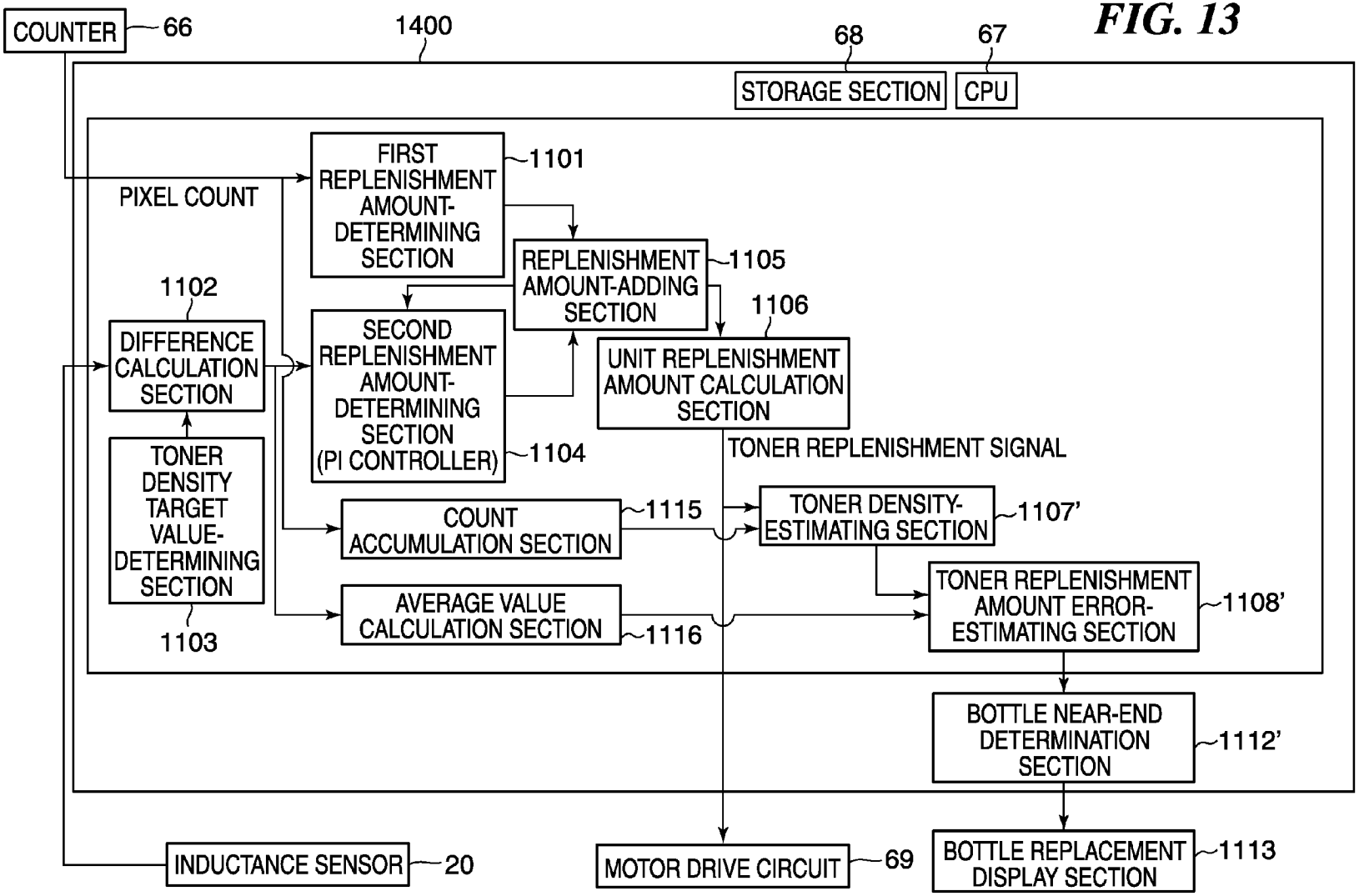
FIG. 13 is a control block diagram of a toner replenishment controller of an image forming apparatus according to a second embodiment of the present invention.

FIG. 13 is a control block diagram of a toner replenishment controller of the image forming apparatus according to the second embodiment of the present invention. Components corresponding to those of the toner replenishment controller of the image forming apparatus according to the first embodiment, shown in FIG. 6, are denoted by the same reference numerals, and description thereof is omitted.

In the toner replenishment controller, denoted by reference numeral 1400, a toner density $D_n$ (n represents a page number, and $D_n$ represents a toner density of an n-th page), which corresponds to the output value from the inductance sensor 20, is input to the difference calculation section 1102. A pixel count from the counter 66 is input to the first replenishment amount-determining section 1101 and a count accumulation section 1115. The toner density target value-determining section 1103 determines a target value $D_{ref}$, and the target value $D_{ref}$ is input to the difference calculation section 1102. The difference calculation section 1102 calculates the difference $\Delta D_n$ between the toner density $D_n$ in the developing chamber 52, detected by the inductance sensor 20, and the toner density target value $D_{ref}$, determined by the toner density target value-determining section 1103, and the difference $\Delta D_n$ is input to the second replenishment amount-determining section 1104 and an average value calculation section 1116. A first toner replenishment amount and a second toner replenishment amount determined by the first replenishment amount-determining section 1101 and the second replenishment amount-determining section 1104, respectively, are input to the replenishment amount-adding section 1105.

The counter 66 calculates a total sum of densities of respective pixels included in each page of image data, based on the signal output from the image signal processing circuit 34. The total sum of densities of respective pixels counted by the counter 66 (the pixel count) corresponds to an amount of toner to be consumed from the developing device 44 for forming a toner image corresponding to one page portion of the image data. Note that a method of acquiring the pixel count is a known technique, and hence description thereof is omitted.

In the present embodiment, the toner replenishment controller 1400 determines an amount of toner to be supplied to the developing device 44 (toner replenishment amount) based on the toner density $D_n$ output from the inductance sensor 20 and the pixel count output from the counter 66. Further, the controller 1400 controls the motor drive circuit 69 to rotate the conveying screw 62 to thereby supply the toner 63 in the toner bottle 60 (see FIG. 1) until the cumulative value of the determined toner replenishment amount becomes a value smaller than a predetermined value.

Toner is supplied from the toner bottle 60 to the developing device 44 in a predetermined replenishment amount which is a defined amount of replenishment per one time. The defined amount of replenishment per one time is an amount of toner supplied by one rotation of the conveying screw 62, but it can have variation. The defined amount per one time (also referred to as the "unit replenishment amount") is a nominal replenishment amount indicative of an amount of toner to be supplied by one replenishment operation (per one rotation of the conveying screw 62), and is a fixed value.

The unit replenishment amount calculation section 1106 generates a toner replenishment signal which is on, when outputting a drive command for supplying toner to the motor drive circuit 69. The toner replenishment signal is a signal which is turned on and off in pulses for instructing the motor drive circuit 69 to supply toner from the toner bottle 60 in an amount corresponding to one rotation of the conveying screw 62. The toner replenishment signal is turned on whenever one replenishment operation is performed. The toner replenishment signal is output to the motor drive circuit 69 and a toner density-estimating section 1107'.

The count accumulation section 1115 calculates a count cumulative value $\Sigma C$ by accumulating the pixel count input from the counter 66, and outputs the calculated count cumulative value $\Sigma C$ to the toner density-estimating section 1107'. The average value calculation section 1116 calculates an average value X, and outputs the average value X to a replenishment amount error-estimating section 1108'. The average value X is a value calculated by averaging the difference $\Delta D_n$ between the toner density $D_n$ detected by the inductance sensor 20 and the target value $D_{ref}$ output from the toner density target value-determining section 1103. Upon receipt of the toner replenishment signal (replenishment request) which is on, the toner density-estimating section 1107' estimates the amount of toner (toner density) in the developing device 44 based on the count cumulative value ΣC and the unit replenishment amount, and outputs the estimated toner amount to the replenishment amount error-estimating section 1108' as an estimated toner density EC.

The replenishment amount error-estimating section 1108' estimates the "toner replenishment amount error" based on a difference between the estimated toner density EC and the average value X. The toner replenishment amount error is an error of the actual replenishment amount of toner supplied by the motor 70 with respect to the unit replenishment amount. The replenishment amount error-estimating section 1108' outputs the estimated toner replenishment amount error to a bottle near-end determination section 1112'. When replacement of a toner bottle 60 is required, the bottle near-end determination section 1112' under the control of the CPU 67 causes the bottle replacement display section 1113 to display a message for prompting the user to replace the toner bottle 60.

The toner replenishment control process performed by the toner replenishment controller of the image forming apparatus according to the second embodiment is the same as the toner replenishment control process described with reference to FIG. 5, and hence description thereof is omitted.

Figure 14:
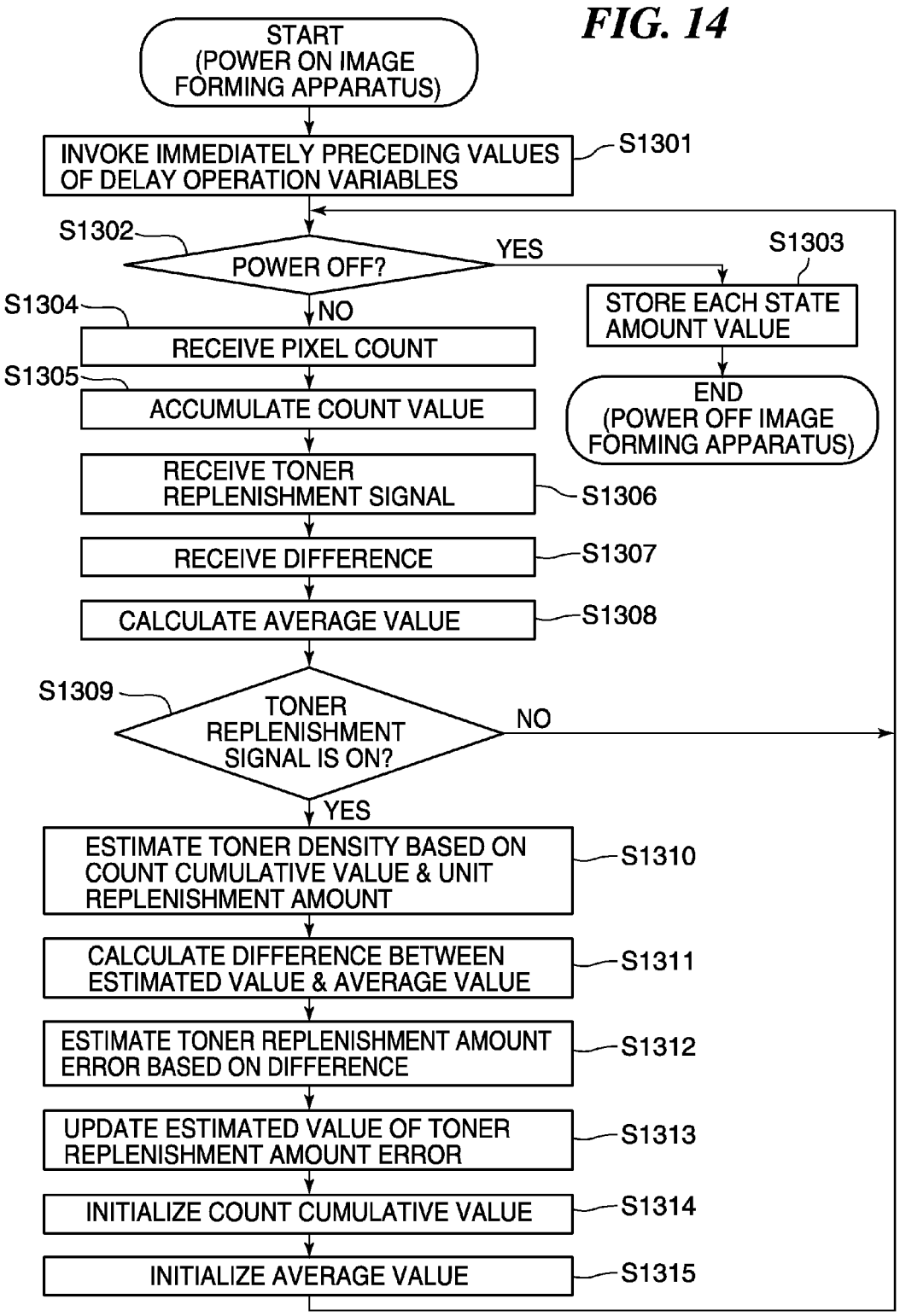
FIG. 14 is another flowchart of the first bottle near-end determination.

Next, estimation of the toner replenishment amount error will be described with reference to FIG. 14. FIG. 14 is a flowchart of a toner replenishment amount error-estimating process. This process is started when the power of the image forming apparatus is turned on.

First, the CPU 67 invokes the immediately preceding values of delay operation variables from the storage section 68 (step S1301). Note that the delay operation variable includes state amount values stored in a step S1303, referred to hereinafter. It is to be understood that when the power of the image forming apparatus 1000 is turned on for the first time, a predetermined value of each delay operation variable is invoked from the storage section 68. The state amount values include the average value X, the estimated toner density EC, and the count cumulative value ΣC, obtained in steps S1308, S1310, and S1312, respectively, referred to hereinafter. Next, the CPU 67 determines whether or not the power of the image forming apparatus is turned off (step S1302). If it is determined in the step S1302 that the power of the image forming apparatus is turned off, the CPU 67 stores the current state amount values in the storage section 68 (step S1303), followed by terminating the process in FIG. 14. On the other hand, if the power of the image forming apparatus is not turned off, the CPU 67 proceeds to a step S1304. The step S1302 is executed after waiting for a predetermined time period (e.g. 0.1 seconds).

In the step S1304, the CPU 67 receives a pixel count from the counter 66. Then, the CPU 67 controls the count accumulation section 1115 to add the pixel count to the count cumulative value ΣC, and thereby update the count cumulative value ΣC (step S1305). Next, the CPU 67 receives a toner replenishment signal from the unit replenishment amount calculation section 1106 (step S1306), and receives the difference $\Delta D_n$ from the difference calculation section 1102 (step S1307).

Next, the CPU 67 controls the average value calculation section 1116 to calculate the average value X (step S1308). More specifically, the CPU 67 calculates the average value X by dividing a total of values of the differences $\Delta D_n$ between the toner density $D_n$ and the target value $D_{ref}$, which have been obtained over a time period from the preceding toner replenishment operation to the present toner replenishment operation, by the number of the differences $\Delta D_n$.

Next, the CPU 67 determines whether or not the toner replenishment signal is on (step S1309). If it is determined in the step S1309 that the toner replenishment signal is on, the CPU 67 performs the processes for estimating the toner density and estimating the toner replenishment amount error in the step S1310 to a step S1315, whereas if the toner replenishment signal is not on, the CPU 67 returns to the step S1302.

In the step S1310, the CPU 67 controls the toner density-estimating section 1107' to estimate the amount of toner in the developing device 44 as the estimated toner density EC based on the count cumulative value ΣC and the unit replenishment amount as the nominal replenishment amount. The count cumulative value ΣC is an amount of toner consumed after the unit replenishment amount was supplied last time, and hence the difference between the two amounts (unit replenishment amount−count cumulative value ΣC) is the estimated toner density EC. As the toner replenishment amount is larger than the toner consumption amount, the estimated toner density EC becomes higher.

Next, the CPU 67 calculates a difference between the estimated toner density EC estimated by the toner density-estimating section 1107' and the average value X calculated by the average value calculation section 1116 (step S1311). Then, the CPU 67 controls the replenishment amount error-estimating section 1108' to estimate the toner replenishment amount error based on the difference between the estimated toner density EC and the average value X (step S1312). More specifically, the CPU 67 calculates "average value X−estimated toner density EC" as the toner replenishment amount error.

As described above, the toner density-estimating section 1107' uses the nominal value of the replenishment amount per one rotation of the conveying screw 62 (unit replenishment amount) as the reference of the amount of toner to be supplied from the toner bottle 60 to the developing device 44. However, in actuality, the toner replenishment amount per one rotation of the conveying screw 62 has variation. The actual toner replenishment amount error is equal to 0 if the nominal toner replenishment amount is equal to the actual toner replenishment amount, takes a negative value if the actual toner replenishment amount is less than the nominal toner replenishment amount, and takes a positive value if the former is more than the latter. The toner replenishment amount error of the toner bottle 60 is responsible for the difference between the average value X and the estimated toner density EC. The average value X corresponds to a toner density in the developing device 44 which is actually measured with reference to the target value $D_{ref}$. On the other hand, the estimated toner density EC is a toner density in the developing device 44 which is theoretically calculated with reference to the target value $D_{ref}$. Therefore, the toner replenishment amount error can be estimated based on the difference between the average value X and the estimated toner density EC. As the absolute value of the difference between the average value X and the estimated toner density EC is larger, the absolute value of the toner replenishment amount error becomes larger.

Next, the CPU 67 updates the estimated value of the toner replenishment amount error (step S1313). More specifically, the CPU 67 replaces the immediately preceding value of the toner replenishment amount error by the current value of the same. Next, the CPU 67 initializes the count cumulative value ΣC (step S1314), initializes the average value X (step S1315), and returns to the step S1302. Therefore, estimation of the toner replenishment amount error (steps S1310 to S1315) is performed whenever the toner replenishment signal is turned on, and the estimated value is updated every time.

The toner replenishment amount error estimated by the toner replenishment amount error-estimating process in FIG. 14 can be used for various control and determination. For example, the CPU 67 may determine a remaining amount of toner in the toner bottle 60. More specifically, in this case, the CPU 67 controls the bottle near-end determination section 1112' to determine whether or not the toner bottle 60 is in the near-end state (the amount of toner remaining in the bottle is slight) using the estimated toner replenishment amount error. The toner replenishment amount error has a characteristic that the toner replenishment amount error is monotonically reduced in the negative direction in the bottle near-end state. Therefore, the bottle near-end determination can be performed by making use of this characteristic. For example, in a case where reduction of the toner replenishment amount error in the negative direction by a predetermined or more amount continues for a predetermined or longer time period, it is possible to determine that the bottle is in the near-end state. Then, when it is determined that the bottle is in the near-end state, the CPU 67 causes the bottle replacement display section 1113 to display a message for prompting the user to replace the toner bottle 60. These processing steps may be provided after the step S1315 of the process in FIG. 14.

Further, the estimated toner replenishment amount error can also be used for controlling stabilization of the toner density in the developing device 44. For example, it is envisaged to perform control e.g. for correcting the added replenishment amount and/or the replenishment amount buffer value, according to the toner replenishment amount error.

Here, the advantageous effects provided by the estimation of the toner replenishment amount error by the method of the present embodiment are verified.

As one method, the toner density is estimated based on the pixel count acquired from image data whenever each sheet is passed and the unit replenishment amount, and the toner replenishment amount error is sequentially estimated based on a difference between the estimated toner density and the difference $DD_n$ whenever the sheet is passed. However, even when the pixel count corresponding to the image density is input whenever each sheet is passed, unless the replenishment amount buffer value becomes equal to or larger than the predetermined value, toner is not supplied. Therefore, in a case where images each consuming a small amount of toner are continuously formed, the frequency of turning on the toner replenishment signal is low. More specifically, when low-density images are continuously formed, the toner replenishment signal is turned on, for example, only once per several tens of sheets, and remains off during other times. Therefore, in a case where estimation of the toner replenishment amount error is sequentially performed by the method of estimating the toner replenishment amount error whenever each sheet is passed even when toner is not supplied for a long time period, there is a fear that the estimated value of the toner replenishment amount error largely changes.

To cope with this, in the present embodiment, as described above, the CPU 67 performs estimation of the toner replenishment amount error whenever toner is supplied (whenever the toner replenishment signal is turned on). This prevents estimation of the toner replenishment amount error from largely deviating from a proper value even when the image density for image formation is low. Further, as a value corresponding to the toner density actually measured by the developing device 44, which is to be compared with the estimated toner density EC, there is used the average value X of the difference $\Delta D_n$ between the toner density $D_n$ and the target value $D_{ref}$, which is calculated over a time period from the immediately preceding toner replenishment operation to the present toner replenishment operation. This makes it possible to absorb periodic variation of the toner density $D_n$, and thereby reduce an estimation error of the toner replenishment amount error. In a case where the effect of reduction of the estimated error is not expected, it is not necessarily required to use the average value X, but there may be used, for example, one or more differences $\Delta D_n$ obtained immediately before estimation.

A comparison is made between the method of sequentially estimating the toner replenishment amount error whenever a sheet is passed, and the method of estimating the toner replenishment amount error whenever toner is supplied according to the present embodiment, with reference to FIGS. 15A to 15C and FIGS. 16A to 16C.

Figure 15A:
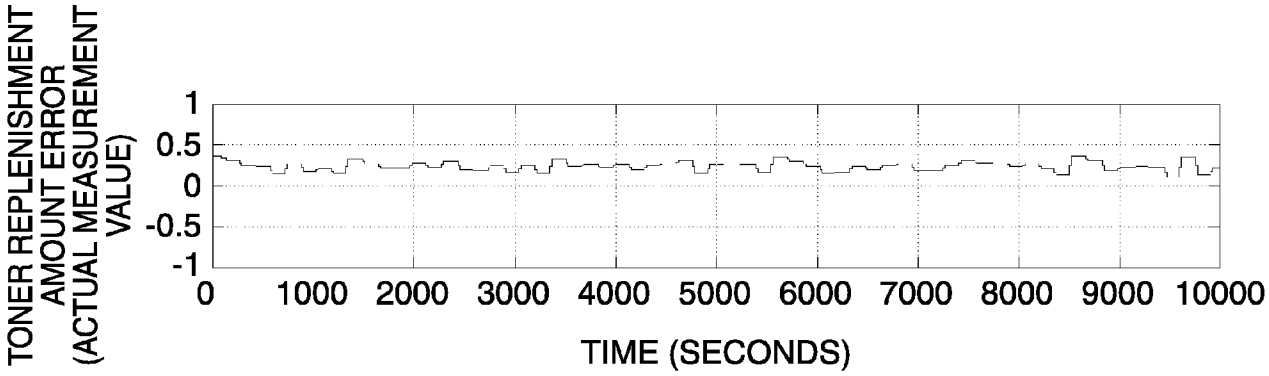
FIGS. 15A to 15C are diagrams of an actual measurement value of the toner replenishment amount error, a toner replenishment signal, and an estimated value of the toner replenishment amount error, respectively, which are used in a method of estimating the toner replenishment amount error whenever a sheet is passed.
Figure 15B:
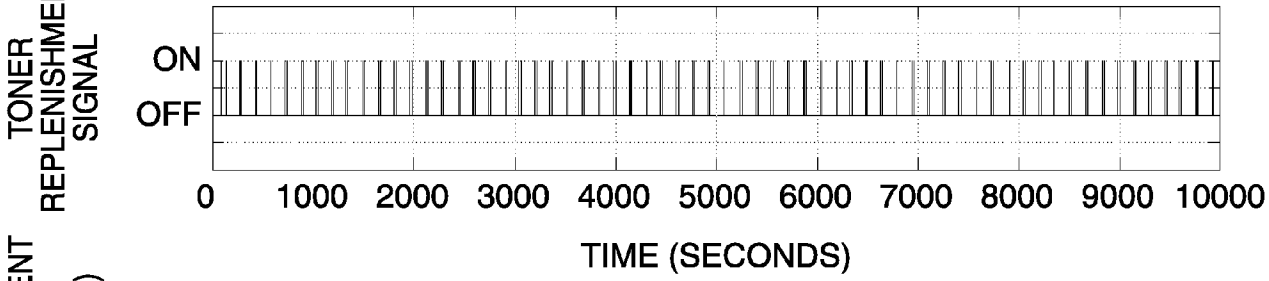
Figure 15C:
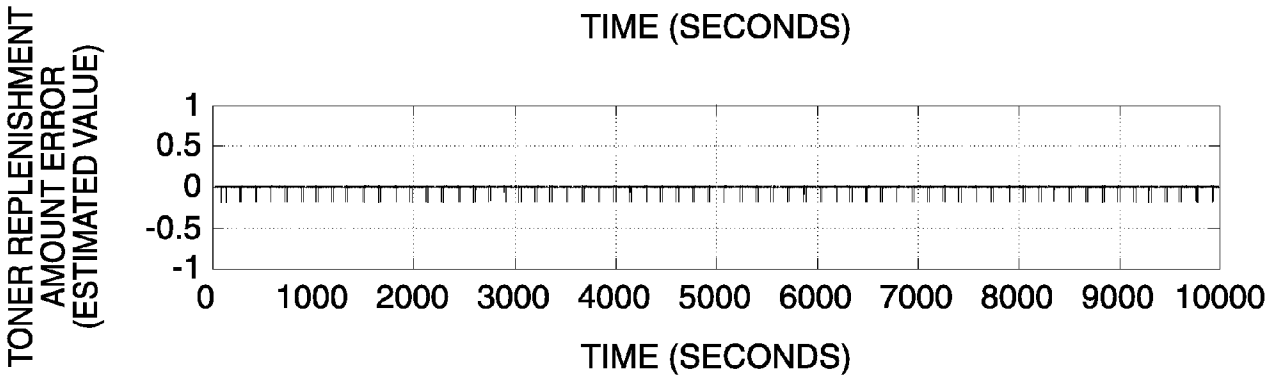

FIGS. 15A, 15B, and 15C are diagrams of the actual measurement value of the toner replenishment amount error, the toner replenishment signal, and the estimated value of the toner replenishment amount error, respectively, which are used in the method of sequentially estimating the toner replenishment amount error whenever a sheet is passed. In FIGS. 15A to 15C, the horizontal axis represents real time (seconds), the vertical axis in FIGS. 15A and 15C represents the toner replenishment amount error, and the vertical axis in FIG. 15B represents on/off of the signal. The description is given of an example in which specific conditions are such that a toner bottle 60 in a brand-new state is set and images having an image density of 2% and an image size of A4 are continuously formed for 10000 seconds.

As shown in FIG. 15A, the actual measurement value of the toner replenishment amount per one rotation of the conveying screw 62 changes in the positive direction with respect to the nominal value, and the actual measurement value of the toner replenishment amount error changes in a range of approximately 1.2 to 1.3 times larger than the nominal value, i.e. in a ratio range of 1.2 to 1.3. By the toner replenishment signal shown in FIG. 15B, only after the replenishment amount buffer value becomes equal to or larger than the predetermined value, toner replenishment is performed. In a case where low-density images are continuously formed, the consumed amount of toner is small, and hence it takes a long time before the replenishment amount buffer value becomes equal to or larger than the predetermined value, and the frequency of toner replenishment is very low. On the other hand, estimation of the toner replenishment amount error is sequentially performed whenever a sheet is passed, and hence in such a case where the interval of turn-on of the toner replenishment signal is large, as in a case where low-density images are formed, it is impossible to accurately estimate the toner replenishment amount error (FIG. 15C).

Figure 16A:
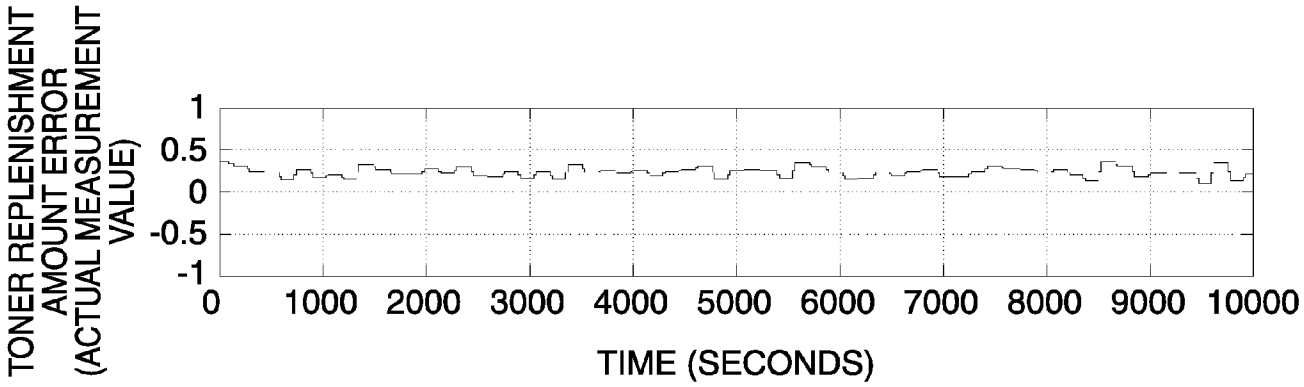
FIGS. 16A to 16C are diagrams of an actual measurement value of the toner replenishment amount error, a toner replenishment signal, and an estimated value of the toner replenishment amount error, respectively, which are used in the method of estimating the toner replenishment amount error whenever a replenishment operation is performed.
Figure 16B:
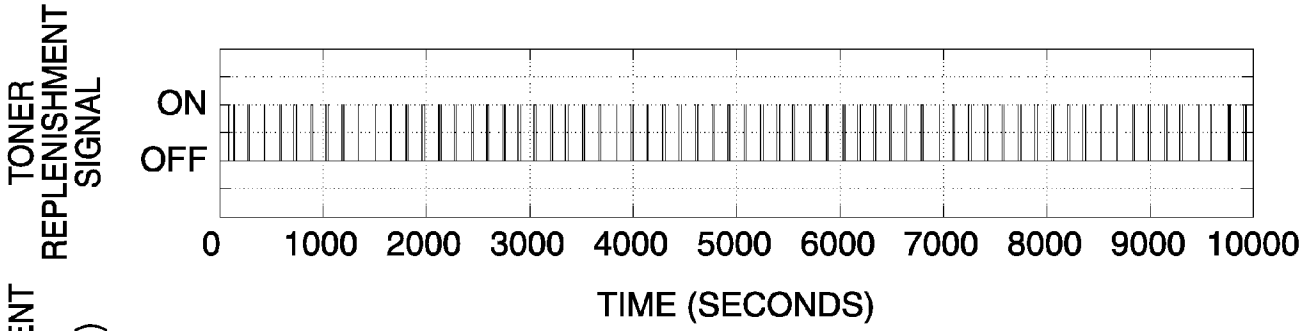
Figure 16C:
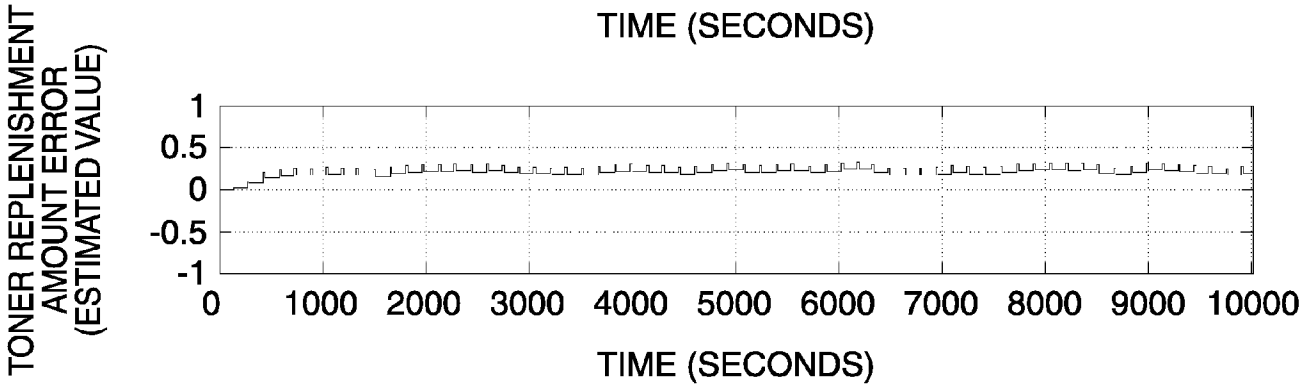

FIGS. 16A, 16B, and 16C are diagrams of the actual measurement value of the toner replenishment amount error, the toner replenishment signal, and the estimated value of the toner replenishment amount error, respectively, which are used in the method of estimating the toner replenishment amount error whenever toner is supplied, according to the present embodiment. In FIGS. 16A to 16C, the horizontal axis and the vertical axis represents the same values as in FIGS. 15A to 15C, and the same image forming conditions as in FIGS. 15A to 15C are applied.

In the present embodiment, estimation of the toner replenishment amount error is performed only when the toner replenishment signal is turned on. As shown in FIG. 16C, the estimated toner replenishment amount error becomes close to the actually measured toner replenishment amount error (FIG. 16A), and compared with FIG. 15C, the toner replenishment amount error can be accurately estimated. As described above, by performing estimation calculation in synchronism with the toner replenishment signal, it is possible to accurately estimate the toner replenishment amount error even in such a case where the interval of turn-on of the toner replenishment signal is large, as in a case where low-density images are continuously formed.

According to the present embodiment, it is possible to accurately estimate the toner replenishment amount error independently of the image density in image formation.

The present invention can be applied to the configuration in which toner is directly supplied from a toner bottle to a developing device without a hopper, such as a compact image forming apparatus.

Note that the toner replenishment amount error estimated in the step S1312 of the process in FIG. 14 is only required to be an error of the actual toner replenishment amount with respect to the unit replenishment amount, and any value may be used insofar as it indicates variation of the toner replenishment amount. Therefore, the toner replenishment amount error may be expressed as a ratio of the average value X to the estimated toner density EC in place of the "difference between the average value X and the estimated toner density EC".

In the step S1308 of the toner replenishment amount error-estimating process in FIG. 14, the average value X is calculated using the difference $\Delta D_n$, and in the step S1310, the estimated toner density EC is obtained using the difference between the unit replenishment amount and the count cumulative value ΣC. However, each value may be calculated by using a ratio instead of using the difference. More specifically, the average value X is calculated using "$\Delta D_n = D_n - D_{ref}$", and the estimated toner density EC is calculated using "unit replenishment amount−count cumulative value ΣC". However, the average value X may be calculated using "$D_n/D_{ref}$", and the estimated toner density EC may be calculated using "unit replenishment amount/count cumulative value ΣC" instead of using the above expressions.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-203057 filed Oct. 1, 2014, and No. 2015-027509, filed Feb. 16, 2015, which are hereby incorporated by reference herein in their entirety.

What is claimed is:

1. An image forming apparatus comprising:

a photosensitive member;

an exposure unit configured to expose the photosensitive member based on image data to form an electrostatic latent image;

a developing unit configured to develop the electrostatic latent image using toner;

a container configured to contain toner;

a replenishment unit configured to replenish the toner to the developing unit from the container;

a detection unit configured to detect an amount of the toner contained in the developing unit:

a calculation unit configured to calculate a difference value between the amount of the toner detected by the detection unit and a target toner amount an accumulation unit configured to accumulate the difference value calculated by the calculation unit;

a controller configured to control the replenishment unit based on the difference value calculated by the calculation unit and the accumulated value accumulated by the accumulation unit: and a determination unit configured to obtain an amount of toner consumed by the developing unit based on the image data, obtain the amount of toner contained in the developing unit based on a detecting result of the detection unit, determine, based on the amount of the consumed toner and the amount of the contained toner, whether or not an error of an amount of the toner replenished by the replenishment unit is larger than a threshold value, and determine, based on the number of times that the error is determined, whether or not replacement of the container is required.

2. The image forming apparatus according to claim 1, wherein the determination unit determines that it is necessary to perform replacement of the container before the container becomes empty.

3. The image forming apparatus according to claim 1, further comprising a notifying unit configured to notify that the replacement of the container is required, based on a determination result of the determination unit.

4. The image forming apparatus according to claim 1, wherein the controller further determines an amount of the toner consumed by the developing unit based on the image data, and controls the replenishment unit based on the amount of the consumed toner, the difference value, and the accumulated value.

5. The image forming apparatus according to claim 1, wherein the determination unit determines whether or not the error of the amount of the toner replenished by the replenishment unit is larger than a predetermined value whenever the controller performs a replenishment operation of the replenishment unit.

6. The image forming apparatus according to claim 1, wherein the replenishment unit includes a motor that rotates the container to replenish the toner to the developing unit.

7. The image forming apparatus according to claim 6, wherein the determination unit determines whether or not the error of the amount of the toner replenished by the replenishment unit is larger than a predetermined value whenever the controller causes the motor to rotate by a predetermined amount.

8. The image forming apparatus according to claim 1, wherein the determination unit determines that replacement of the container is required when the number of times that the error is determined is larger than a predetermined number of times.

* * * * *